US009387679B2

(12) United States Patent
Shiiba et al.

(10) Patent No.: US 9,387,679 B2
(45) Date of Patent: Jul. 12, 2016

(54) INK JET RECORDING METHOD AND INK JET RECORDING APPARATUS

(71) Applicant: CANON KABUSHIKI KAISHA, Tokyo (JP)

(72) Inventors: Kenichi Shiiba, Warabi (JP); Masashi Ogasawara, Machida (JP); Daiji Okamura, Tokyo (JP); Kousuke Yamasaki, Kawasaki (JP); Atsushi Takahashi, Tama (JP); Tomoyuki Tenkawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/568,562

(22) Filed: Dec. 12, 2014

(65) Prior Publication Data

US 2015/0183220 A1 Jul. 2, 2015

(30) Foreign Application Priority Data

Dec. 27, 2013 (JP) ..... 2013-272238
Jun. 16, 2014 (JP) ..... 2014-123260
Nov. 25, 2014 (JP) ..... 2014-237799

(51) Int. Cl.
*B41J 2/165* (2006.01)

(52) U.S. Cl.
CPC ..... *B41J 2/16526* (2013.01); *B41J 2/16532* (2013.01); *B41J 2/16538* (2013.01)

(58) Field of Classification Search
CPC ..... B41J 2/16552; B41J 2/16535
See application file for complete search history.

(56) References Cited

U.S. PATENT DOCUMENTS

| | | | | |
|---|---|---|---|---|
| 5,493,319 | A * | 2/1996 | Hirabayashi et al. | 347/29 |
| 8,136,909 | B2 | 3/2012 | Ogasawara et al. | |
| 2012/0219769 | A1* | 8/2012 | Nagahama et al. | 428/195.1 |
| 2012/0306976 | A1* | 12/2012 | Kitagawa et al. | 347/100 |
| 2013/0100200 | A1 | 4/2013 | Hamasaki et al. | |
| 2013/0135382 | A1* | 5/2013 | Mitsuzawa | C09D 11/40 347/20 |
| 2013/0222478 | A1* | 8/2013 | Ishibashi et al. | 347/33 |
| 2014/0111574 | A1* | 4/2014 | Ozawa | 347/26 |
| 2015/0042715 | A1 | 2/2015 | Hamasaki et al. | |

FOREIGN PATENT DOCUMENTS

| | | | |
|---|---|---|---|
| JP | 11-263024 | A | 9/1999 |
| JP | 2003-341080 | A | 12/2003 |
| JP | 2004-285344 | A | 10/2004 |
| JP | 2005-169201 | A | 6/2005 |
| JP | 2005-254463 | A | 9/2005 |
| JP | 2009-101632 | A | 5/2009 |

* cited by examiner

*Primary Examiner* — Stephen Meier
*Assistant Examiner* — John P Zimmermann
(74) *Attorney, Agent, or Firm* — Fitzpatrick, Cella, Harper & Scinto

(57) ABSTRACT

An ink jet recording method for recording an image onto a recording medium by ejecting an aqueous ink containing a resin from an ejection orifice through use of an ink jet recording apparatus including a recording head having a water-repellent face subjected to water-repellent treatment as an ejection orifice face provided with an ejection orifice; a wiping unit configured to wipe the water-repellent face; and a heating unit configured to heat the water-repellent face, the ink jet recording method including a heating step of wiping the water-repellent face with the wiping unit after heating the water-repellent face with the heating unit and continuously heating the water-repellent face until after the wiping of the water-repellent face.

21 Claims, 8 Drawing Sheets

INK JET RECORDING METHOD AND INK JET RECORDING APPARATUS

BACKGROUND OF THE INVENTION

1. Field of the Invention

The present invention relates to an ink jet recording method and an ink jet recording apparatus to be used in the ink jet recording method.

2. Description of the Related Art

In recent years, along with the enhancement of image quality and the increase in recording speed, an ink jet recording apparatus has had increasing opportunities for being used not only in outputting photographic images and Web pages at home but also in the business field such as offices. Ink for an ink jet recording apparatus to be used for output objects such as business documents has been required to have reliability such as high-level ejection stability and to exhibit advanced image characteristics. For example, the ink has been required to be capable of recording an image excellent in highlighter resistance in which the surface of the image is not contaminated easily even when a marking pen or the like is dragged on the surface. In order to satisfy the above-mentioned demands, for example, an attempt has been made so as to enhance the fastness of an image to be recorded through use of ink having added thereto a resin (see Japanese Patent Application Laid-Open No. 2004-285344).

On the other hand, in the case where aqueous ink containing a resin is ejected to perform recording through use of an ink jet recording apparatus having mounted thereon a recording head having a water-repellent face subjected to water-repellent treatment as an ejection orifice face provided with an ejection orifice, there arises a new problem in that ejection failure or the like is liable to occur. The ejection orifice face subjected to water-repellent treatment is hereinafter sometimes referred to as "water-repellent face." For example, ink having added thereto a resin having characteristics of easily adhering or adsorbing to the water-repellent face is liable to be accumulated in the vicinity of the ejection orifice. Therefore, an ink droplet to be ejected from the ejection orifice is attracted to the ink accumulated in the vicinity of the ejection orifice, with the result that the ink droplet is applied to a position different from an intended position. Such degradation in ejection accuracy significantly influences the quality of an image to be recorded.

When a resin having high water solubility is added to ink, the contact angle of the ink with respect to the water-repellent face can be kept high. Therefore, a resin having a high acid value has been added to aqueous ink in order to relieve the above-mentioned problem of the degradation in ejection accuracy. The wetting and spreading of ink on the water-repellent face is suppressed through use of the resin having a high acid value, with the result that the ink is less liable to be accumulated in the vicinity of the ejection orifice.

On the other hand, there has also been proposed a recording apparatus in which the removability of ink in the vicinity of the ejection orifice is enhanced. For example, there has been proposed a recording apparatus including a cleaning member capable of cleaning an ejection orifice face by wiping, in which the removability of ink is enhanced by selecting an appropriate wiping speed in accordance with the viscosity of the ink (see Japanese Patent Application Laid-Open No. 2003-341080). Further, it has been proposed that the recording apparatus includes a unit for wiping the ejection orifice face and a unit for heating the surface, and the viscosity of accumulated ink is lowered by heating the vicinity of the ejection orifice before wiping to enhance the removability of the accumulated ink (see Japanese Patent Application Laid-Open No. H11-263024 and Japanese Patent Application Laid-Open No. 2005-254463). It has also been proposed that the unit for wiping is heated, and a liquid different from ink is prepared for wiping and wiping is performed while supplying the liquid in a heated state to the ejection orifice face to enhance the removability of the accumulated ink (see Japanese Patent Application Laid-Open No. 2005-169201 and Japanese Patent Application Laid-Open No. 2009-101632).

SUMMARY OF THE INVENTION

The inventors of the present invention conducted further investigations regarding aqueous ink containing a resin. As a result, the inventors of the present invention have found that it is difficult to record an image excellent in highlighter resistance while enhancing the ejection accuracy. A general ink jet recording apparatus includes a unit for wiping an ejection orifice face with a wiping member in the case where predetermined conditions are satisfied so as to prevent ink splashed after ejection from adhering to the vicinity of an ejection orifice to inhibit the subsequent ejection of ink. It was found that, in the case where ink containing a resin is ejected to record an image by the above-mentioned ink jet recording apparatus, the ejection accuracy of ink just after the wiping with the wiping member is remarkably degraded in some cases.

In order to solve the above-mentioned problem, the inventors of the present invention have recorded an image similarly through use of ink containing a resin having a high acid value. However, the inventors of the present invention could not confirm clear improvement effects. That is, it was found that, even in the case where the contact angle of ink with respect to the water-repellent face is increased, it is difficult to suppress the degradation in ejection accuracy of ink.

In view of the foregoing, the inventors of the present invention conducted further investigations so as to clarify the cause for the degradation in ejection accuracy of ink. As a result, the inventors of the present invention have found that the flowability of the aqueous ink containing a resin on the water-repellent face is remarkably degraded. The aqueous ink on the water-repellent face is wiped with the wiping member to be temporarily spread to a wide range of the water-repellent face, and thereafter, contracts rapidly to form a circular liquid droplet. Note that, it was found that in the case of the aqueous ink containing a resin, it takes a long time for the aqueous ink to form a circular liquid droplet after being spread by wiping. That is, in the vicinity of the ejection orifice just after wiping, the ink remains wet and spread without contracting sufficiently. Presumably, such state inhibits the subsequent ejection of ink to degrade the ejection accuracy.

Next, the inventors of the present invention have attempted to enhance the ejection accuracy of ink just after wiping with the techniques proposed in the above-mentioned patent literatures. As a result, it was found that it is difficult to enhance the ejection accuracy of ink just after wiping to a satisfactory level even in the case where any techniques proposed in the above-mentioned patent literatures are adopted.

For example, Japanese Patent Application Laid-Open No. 2003-341080 proposes the technique of selecting an appropriate wiping speed in accordance with the viscosity of ink. However, in the case where aqueous ink containing a resin is ejected, the flowability of the ink on the water-repellent face is not so enhanced even when the water-repellent face is wiped at various wiping speeds, with the result that sufficient ejection accuracy is not obtained. Further, even with the technique of heating the vicinity of the ejection orifice before wiping, proposed in Japanese Patent Application Laid-Open No. H11-263024 and Japanese Patent Application Laid-Open No. 2005-254463, sufficient ejection accuracy cannot be obtained in the case of ejecting aqueous ink containing a resin. Further, even with the technique of heating the unit for wiping and performing wiping while supplying the liquid for wiping in a heated state to the ejection orifice face, proposed in Japanese Patent Application Laid-Open No. 2005-169201 and Japanese Patent Application Laid-Open No. 2009-101632, sufficient ejection accuracy cannot be obtained, either. It was found from the above-mentioned results that it is difficult to satisfy both the highlighter resistance of an image to be recorded and the ejection accuracy of ink at a high level.

Accordingly, it is an object of the present invention to provide an ink jet recording method capable of recording an image excellent in highlighter resistance as well as of ejecting aqueous ink containing a resin with excellent accuracy. It is another object of the present invention to provide an ink jet recording apparatus to be used preferably in the ink jet recording method.

The above-mentioned objects are achieved by the present invention described below. That is, according to an embodiment of the present invention, there is provided an ink jet recording method for recording an image onto a recording medium by ejecting an aqueous ink containing a resin from an ejection orifice through use of an ink jet recording apparatus including: a recording head having a water-repellent face subjected to water-repellent treatment as an ejection orifice face provided with an ejection orifice; a wiping unit configured to wipe the water-repellent face; and a heating unit configured to heat the water-repellent face, the ink jet recording method including a heating step of heating the water-repellent face with the heating unit, then wiping the water-repellent face with the wiping unit, and continuously heating the water-repellent face until after the wiping of the water-repellent face.

According to an embodiment of the present invention, it is possible to provide an ink jet recording method capable of recording an image excellent in highlighter resistance as well as of ejecting aqueous ink containing a resin with excellent accuracy. According to another embodiment of the present invention, it is possible to provide an ink jet recording apparatus to be used preferably in the ink jet recording method.

Further features of the present invention will become apparent from the following description of exemplary embodiments with reference to the attached drawings.

DESCRIPTION OF THE EMBODIMENTS

Figure 1:
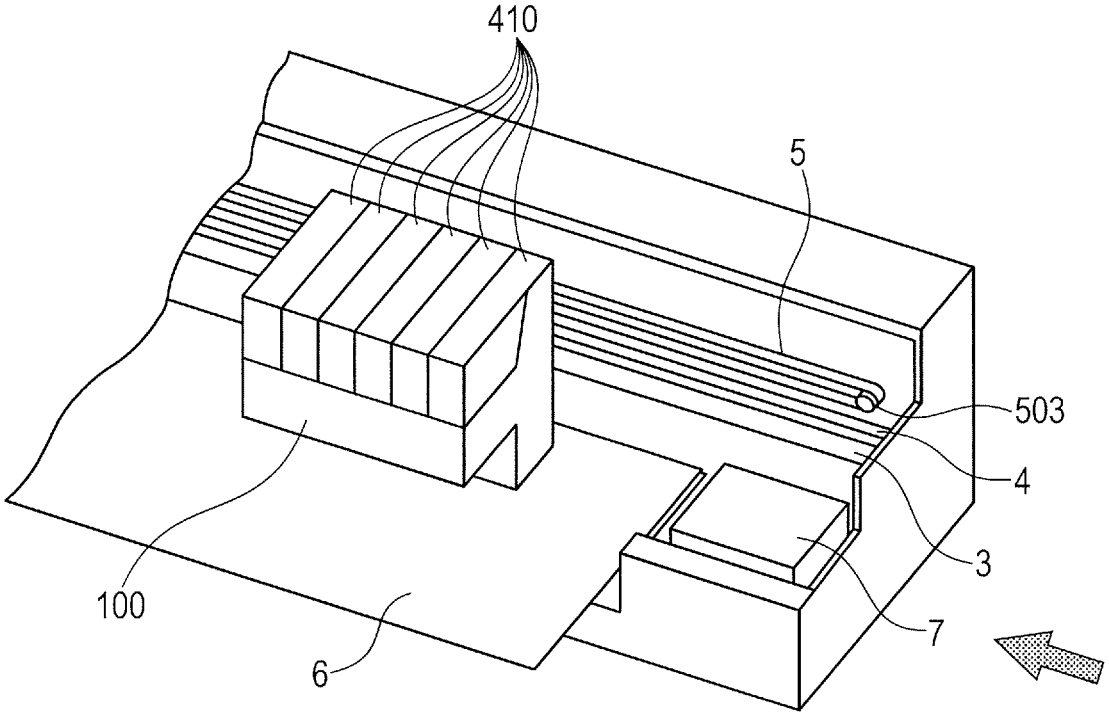
FIG. 1 is a perspective view schematically illustrating an example of main portions of an ink jet recording apparatus.

Preferred embodiments of the present invention will now be described in detail in accordance with the accompanying drawings.

The present invention is hereinafter described in detail by way of exemplary embodiments. However, the present invention is not limited to the following embodiments. Note that, various physical property values as described herein refer to values at 25° C., unless otherwise specified.

An ink jet recording method of the present invention uses an ink jet recording apparatus including a recording head having a water-repellent face subjected to water-repellent treatment as an ejection orifice face provided with an ejection orifice, a wiping unit configured to wipe the water-repellent face, and a heating unit configured to heat the water-repellent face. In addition, the ink jet recording method includes recording an image onto a recording medium by ejecting an aqueous ink containing a resin from the ejection orifice.

The inventors of the present invention conducted studies regarding the adhesion force and adsorption force of ink with respect to the water-repellent face. Specifically, the inventors of the present invention quantified adhesion energy acting between the ink and the water-repellent face. The adhesion energy is a physical property value serving as an index of the adhesiveness between a liquid and the surface of a solid and is known to be represented by the following equation (1).

$$\text{Adhesion energy } E = mg \cdot \sin \alpha / 2\pi r \quad (1)$$

α: slide angle
r: attached contact radius
m: liquid droplet mass
g: gravitational acceleration The adhesion energy can be measured and calculated through use of a general contact angle gauge. Examples of the contact angle gauge include a solid-liquid interfacial analyzer (trade name: "DropMaster 700", manufactured by Kyowa Interface Science Co., Ltd.). Specifically, first, actual measurement values of a sliding angle at a time of liquid droplet sliding and of an attached droplet radius with respect to a water-repellent face are obtained under the conditions of a liquid droplet size of 15 μL, a maximum inclination of 90°, and a slide recognition setting of 2 dots. Then, adhesion energy can be calculated from equation (1) through use of the obtained actual measurement values of the slide angle and the attached droplet radius. As a result of measuring and calculating the adhesion energy, it was revealed that the adhesion energy increases greatly when ink contains a resin.

The inventors of the present invention presume the reason that the adhesion energy increases in the case where ink contains a resin as follows. As the resin widely used in aqueous ink for ink jet, there are mentioned, for example, an acrylic resin and a urethane resin. These resins have a site exhibiting hydrophobicity in a molecule thereof. It is considered that the site exhibiting hydrophobicity causes a hydrophobic interaction with a hydrophobic portion of the water-repellent face, which increases the adhesion energy.

On the other hand, the viscosity of ink is known as a factor for influencing the flowability of the ink on the water-repellent face. The inventors of the present invention prepared the following three kinds of inks (inks (1) to (3)) containing the same amount of a resin capable of recording an image having highlighter resistance at a sufficient level but being provided with different viscosities by adjusting liquid components to evaluate the ejection accuracy. As a result, it was found that the ejection accuracy decreases with increasing viscosity. The reason for this is presumed as follows: even when ink has high adhesion force with respect to the water-repellent face, if the ink itself has low viscosity and high flowability, the movement of a liquid droplet on the water-repellent face becomes smoother.

Ink (1): viscosity of 2.0 mPa·s

Ink (2): viscosity of 3.0 mPa·s

Ink (3): viscosity of 4.0 mPa·s

The ejection accuracy of ink tends to be enhanced by decreasing the viscosity. However, the ejection accuracy was not considered to be sufficient even in the ink (1) having the lowest viscosity (2.0 mPa·s). Further, in order to record an image having excellent highlighter resistance, it is necessary that ink contain a somewhat great amount of a resin. However, even when a resin having a high water solubility and a high acid value or an insolubilized particulate resin is used, the viscosity of ink to be obtained becomes high to some degree. Therefore, it is substantially difficult to obtain ink having a low viscosity of 2.0 mPa·s or less while allowing the ink to contain a certain amount of a resin in order to record an image having excellent highlighter resistance.

Accordingly, it was found that, in order to enhance the ejection accuracy of aqueous ink containing a resin, it is important to decrease the adhesion force of the ink with respect to the water-repellent face and to decrease the viscosity of the ink. The inventors of the present invention conducted further studies regarding measures for decreasing the adhesion force of ink with respect to the water-repellent face and decreasing the viscosity of ink. As a result, it was found that both of the above-mentioned effects are obtained if the state in which the water-repellent face is heated is kept. First, the adhesion energy of ink containing a resin with respect to a heated water-repellent face was quantified. As a result, it was found that the adhesion energy with respect to the heated water-repellent face is lower than the adhesion energy with respect to a non-heated water-repellent face. The reason for this is presumed by the inventors of the present invention as follows.

As described above, it is considered that the adhesion energy of ink containing a resin is increased by the hydrophobic interaction between the resin and the hydrophobic portion of the water-repellent face. In general, the hydrophobic interaction depends on the temperature, and the hydrophobic interaction becomes stronger under high-temperature conditions. When aqueous ink adheres to the water-repellent face, an ink droplet contracts so that the contact area becomes minimum due to the interfacial tension with respect to the water-repellent face. Note that, when a resin is present in ink, the hydrophobic interaction acts between the resin and the water-repellent face, and hence the contraction of the ink droplet is delayed. However, under the continuously heated conditions, the hydrophobic interaction between resins in the ink acts more strongly. Therefore, it is considered that the hydrophobic portion of the resin oriented to the water-repellent face is reduced, and the adhesion energy between the ink and the water-repellent face decreases.

On the other hand, it is generally known that the viscosity of ink is decreased by heating. This is because the movement of molecules in ink is activated by heating, and the resistance caused by the intermolecular force is weakened. Most of the resins in aqueous ink have peculiar viscosities, and hence the temperature dependency of the viscosity of ink containing a resin increases. Therefore, it is considered that the viscosity of an ink droplet on the water-repellent face is decreased greatly by heating the water-repellent face continuously.

Further, the inventors of the present invention conducted studies regarding the optimum heating conditions for suppressing the decrease in ejection accuracy occurring in an image recorded by ejecting ink just after wiping with the wiping member. As a result, the inventors of the present invention found that the above-mentioned decrease in ejection accuracy occurring just after wiping with a wiping member can be remarkably suppressed, if the water-repellent face provided with an ejection orifice is heated continuously during a period of before wiping, during wiping, and after wiping.

For example, it was found that the effect of suppressing the decrease in ejection accuracy is hardly obtained if the water-repellent face is heated only before wiping with the wiping member. The reason for this is considered as follows. The adhesion force of ink with respect to the water-repellent face is decreased to some degree by heating, and the viscosity of the ink is also decreased. However, the effect of decreasing the adhesion force and viscosity of ink is almost lost after wiping because the water-repellent face is not heated continuously until after wiping.

Further, it was found that the effect of suppressing the decrease in ejection accuracy is hardly obtained also in the case where the water-repellent face is heated only after wiping with the wiping member. The reason for this is considered as follows. It is difficult to just increase the flowability of ink on the water-repellent face even by heating the water-repellent face only after wiping, and it is difficult to impart the sufficient flowability to ink by the time when a recording action is performed.

Further, it was found that the effect of suppressing the decrease in ejection accuracy is not obtained even in the case of heating the wiping member or even in the case of performing wiping while supplying a liquid for wiping in a heated state to an ejection orifice face. The reason for this is considered as follows. The contact period between the ink and the heated wiping member or the liquid for wiping is short, and it is difficult to enhance the flowability of ink on the water-repellent face.

Based on the above-mentioned results, the inventors of the present invention conducted studies regarding the introduction of a heating step of the water-repellent face when wiping is performed with the wiping member and the optimization of heating conditions, thereby achieving the present invention. Specifically, the ink jet recording method of the present invention includes a heating step of wiping a water-repellent face with a wiping unit after heating the water-repellent face with a heating unit and continuously heating the water-repellent face until after the wiping of the water-repellent face. Now, the ink jet recording method of the present invention, and an ink jet recording apparatus, recording head, ink, and the like to be used preferably in the ink jet recording method of the present invention are respectively described.

Recording Apparatus

FIG. 1 is a perspective view schematically illustrating an example of main portions of an ink jet recording apparatus. In the illustrated ink jet recording apparatus, a carriage 100 is fixed to an endless belt 5 and is movable along a guide shaft 3. The endless belt 5 is wound around a pair of pulleys 503, and one of the pulleys 503 is joined to a drive shaft of a main scanning motor (not shown) for driving the carriage 100. Thus, the carriage 100 is reciprocated in a main scanning direction that is a scanning direction of a recording head 1 along the guide shaft 3 along with the rotational drive of a motor. An ink cartridge 410 is removably held on the carriage 100, and a head cartridge 400 including the recording head 1 is mounted thereon. The head cartridge 400 further includes a connector for receiving, for example, a signal for driving the recording head 1. Ink can be ejected and an ejection orifice face (water-repellent face) provided with an ejection orifice can be heated by driving an electrothermal converter provided in the recording head 1 in accordance with an electric signal.

Figure 2:
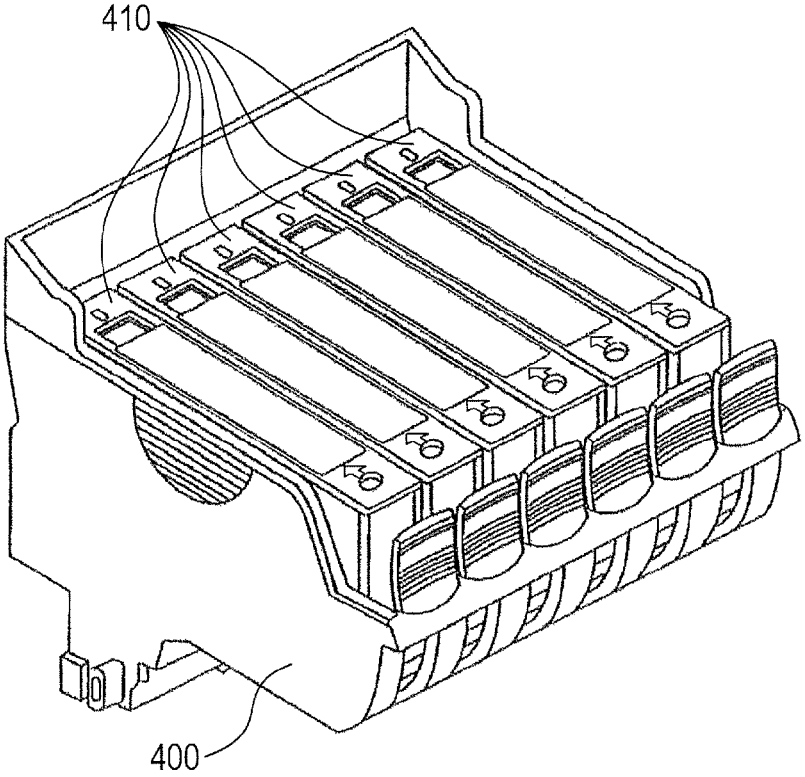
FIG. 2 is a perspective view illustrating an example of a head cartridge that can be mounted on a carriage of the ink jet recording apparatus illustrated in FIG. 1.

FIG. 2 is a perspective view illustrating an example of the head cartridge 400 that can be mounted on the carriage 100 of the ink jet recording apparatus illustrated in FIG. 1. The head cartridge 400 illustrated in FIG. 2 includes the ink cartridge 410 for containing ink and supplying the ink to the recording head 1. The recording head 1 (FIG. 3) is positioned on a bottom surface of the head cartridge 400. Further, the head cartridge 400 is mounted on the carriage 100 so that an ejection orifice array provided for each kind of ink on the recording head 1 is opposed to a recording medium 6 (FIG. 1) and the array direction is matched with a direction orthogonal to the main scanning direction (sub scanning direction that is a conveyance direction of the recording medium 6). The ejection orifice array and the ink cartridge 410 may be provided in groups corresponding to the number of ink kinds to be used. In the example illustrated in FIGS. 1 and 2, six groups are provided corresponding to six colors (for example, black, cyan, magenta, yellow, pale cyan, and pale magenta).

The recording medium 6 is intermittently conveyed in a direction orthogonal to the scanning direction of the carriage 100 (FIG. 1). Further, the recording medium 6 is conveyed keeping flatness with respect to the ejection orifice while being supported by a pair of roller units (not shown) provided respectively on an upstream side and a downstream side of the conveyance direction and being supplied with predetermined tension. Recording with respect to the entire recording medium 6 is performed while the recording of a width corresponding to an array width of the ejection orifice of the recording head 1 and the conveyance of the recording medium 6 in association with the movement of the carriage 100 are repeated alternately. Further, a linear encoder 4 for, for example, detecting the position of the carriage 100 in the main scanning direction is provided in the ink jet recording apparatus illustrated in FIG. 1.

The carriage 100 is positioned at a home position opposed to a maintenance mechanism 7 during non-recording including a recording start time (FIG. 1). Further, the carriage 100 also moves to the home position as necessary during recording. A cap unit (not shown) and the maintenance mechanism 7 including a cleaning device (FIG. 3) described later are provided in the vicinity of the home position. The cap unit is supported so as to ascend and descend. The cap unit can cap a surface of the recording head 1 provided with the ejection orifice at the ascending position to protect the ejection orifice face during non-recording or the like, or perform suction recovery. During a recording action, the cap unit is set at the descending position avoiding the interference with the recording head 1, and can receive preliminary ejection by being opposed to the ejection orifice face.

Figure 3:
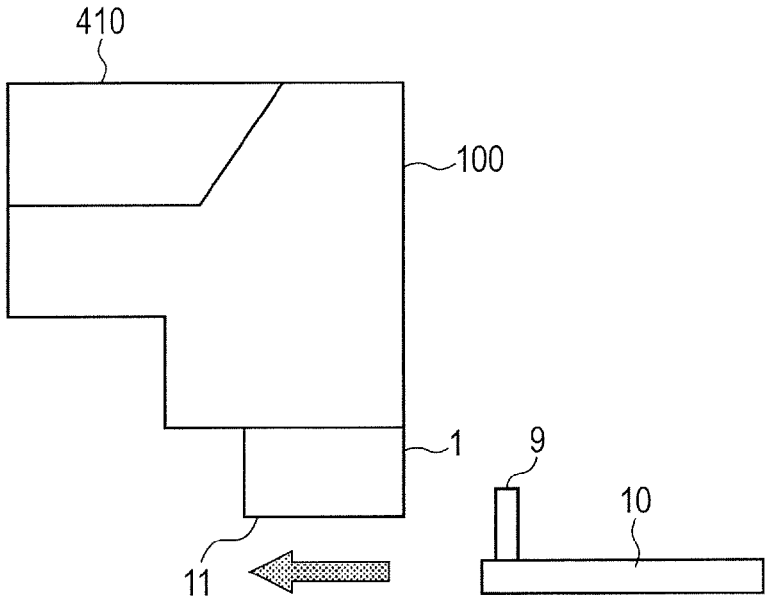
FIG. 3 is a side view schematically illustrating an example of a cleaning device.

FIG. 3 is a side view schematically illustrating an example of the cleaning device. Note that, for simplicity, only a portion of the recording head 1 is illustrated regarding the head cartridge 400. As illustrated in FIG. 3, a wiper 9 formed of an elastic member such as rubber is fixed to a wiper holder 10. Further, the wiper holder 10 can move in a right and left direction of FIG. 3, that is, a direction orthogonal to the scanning direction of the recording head 1. When the wiper 9 is brought into slidable contact with an ejection orifice face 11 provided with the ejection orifice of the recording head 1, the wiper 9 is bent and a side part and a body part thereof are brought into slidable contact with the ejection orifice face 11. Note that, in order to enhance the accuracy of wiping, a plurality of wipers 9 may be provided. Further, there is no limitation on the penetration amount of the wiper 9 with respect to the ejection orifice face 11. During a cleaning action, the wiper holder 10 is moved in the arrow direction after the recording head 1 is moved to the home position. In the course of this movement, the wiper 9 is brought into slidable contact with the ejection orifice face 11, thereby conducting wiping. The effect of wiping can be exhibited as long as the wiping speed is linked with the movement speed of the wiper holder 10 and falls within a practical range. Specifically, the range of 20 mm/sec or more to 300 mm/sec or less is preferred.

Recording Head Section

Figure 4:
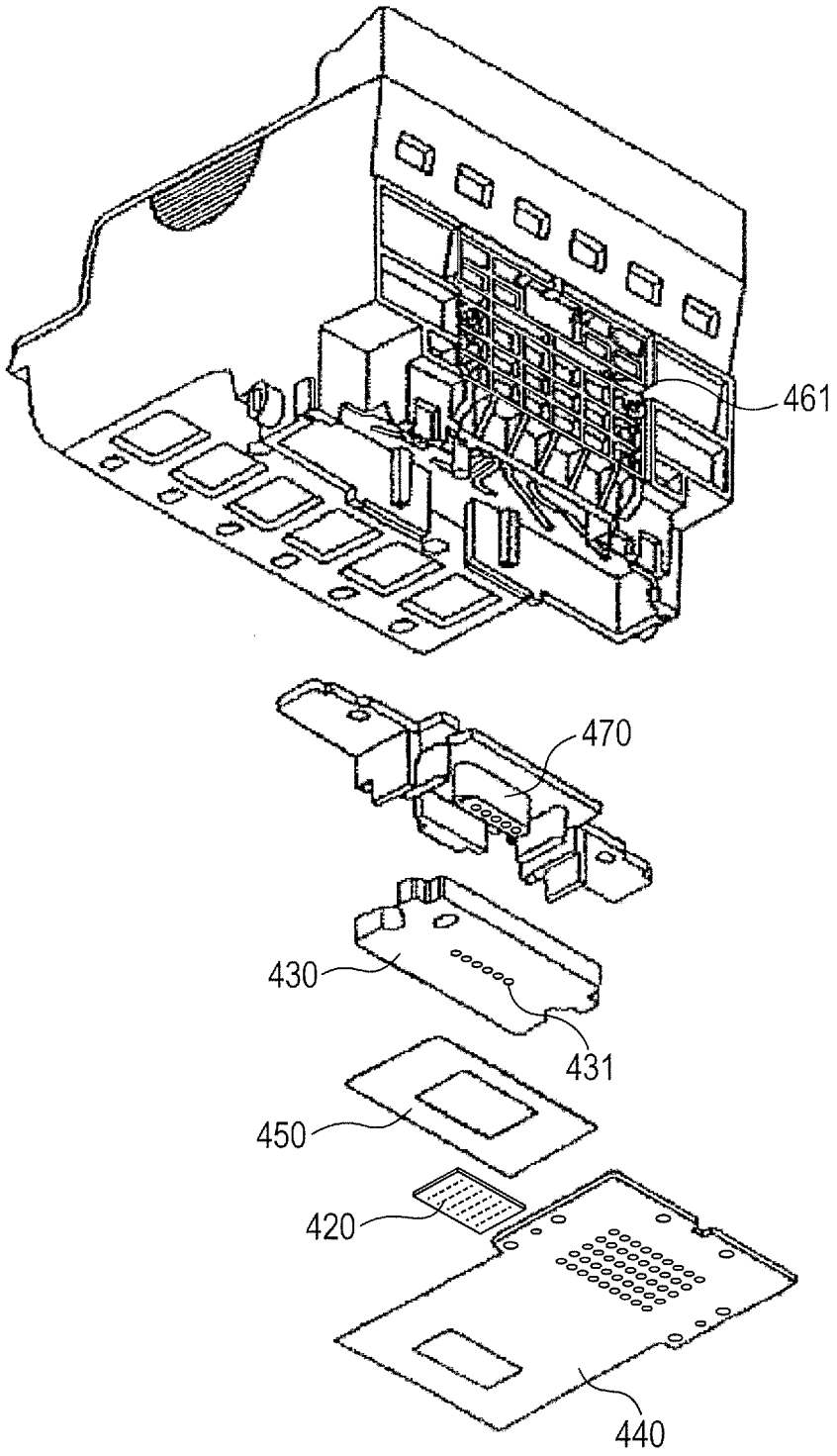
FIG. 4 is a perspective view illustrating the head cartridge illustrated in FIG. 2 in a partially exploded state.

FIG. 4 is a perspective view illustrating the head cartridge 400 illustrated in FIG. 2 in a partially exploded view. As illustrated in FIG. 4, a recording head section of the head cartridge 400 illustrated in FIG. 2 includes a recording element substrate 420, a first plate 430, an electric wiring board 440, a second plate 450, a cartridge holder 461, and a flow path forming member 470. The recording element substrate 420 including an ejection orifice array for each ink is bonded and fixed onto the first plate 430 formed of a material having heat radiation properties such as aluminum oxide ($Al_2O_3$). Further, an ink supply port 431 for supplying ink to the recording element substrate 420 is formed on the first plate 430, and the second plate 450 having an opening is bonded and fixed onto the first plate 430. The second plate 450 is provided so as to align the height of the ejection orifice face 11 of the recording element substrate 420 with the height of the surface of the electric wiring board 440 to which an electric signal for ejecting ink is applied. The electric wiring board 440 and the recording element substrate 420 are bonded and fixed onto the second plate 450 so as to be connected to each other electrically. On the other hand, the flow path forming member 470 is ultrasonically welded to a lower part of the cartridge holder 461 for removably holding the ink cartridge 410, thereby forming an ink flow path (not shown) extending from the ink cartridge 410 to the first plate 430.

Figure 5:
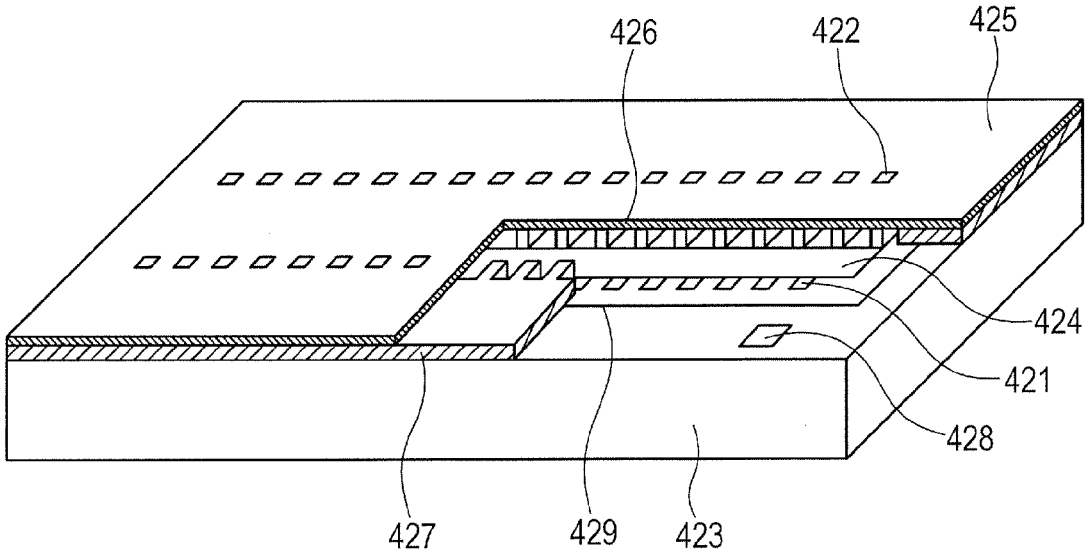
FIG. 5 is a perspective view illustrating a structure in the vicinity of an ejection orifice of a recording element substrate illustrated in FIG. 4 in a partially broken state.

FIG. 5 is a perspective view illustrating a structure in the vicinity of an ejection orifice of the recording element substrate 420 illustrated in FIG. 4 in a partially broken view. In FIG. 5, there is provided a first electrothermal converter (heater) 421 for generating, as energy to be used for ejecting ink, heat energy for causing film boiling in ink in response to the application of current. Further, on a base 423 on which the electrothermal converter 421 is mounted, a temperature sensor 428 for detecting the temperature of the recording element substrate 440 and a second electrothermal converter (sub heater) 429 for performing heating for retaining heat in the recording head 1 and the ink in accordance with the detected temperature are provided. An ejection orifice 422, an ink supply port 424, and a flow path wall 426 are provided. An ejection orifice plate 425 is provided with the ejection orifice 426 while being opposed to the heater (first electrothermal converter 421) for ejecting ink and arranged on the base 423 through a covering layer 427 formed of a resin or the like. Further, the surface (ejection orifice face opposed to the recording medium 6) of the ejection orifice plate 425 is subjected to water-repellent treatment to serve as a water-repellent face. Note that, the ink jet recording apparatus may have a configuration in which the temperature (outside temperature) of the environment in which the ink jet recording apparatus is placed is detected, and the temperature conditions of heating including heat retention are set in accordance with the detected temperature. Further, even in the case of not using heat energy for ejecting ink as in a piezoelectric system, the water-repellent face can be heated as long as a heater corresponding to the second electrothermal converter 429 is provided.

As for a method of forming the water-repellent face by subjecting the ejection orifice face provided with the ejection orifice to water-repellent treatment, a method involving applying a water-repellent material to the ejection orifice face by spraying, a method involving causing a water-repellent material to adhere to the ejection orifice face by vacuum deposition or plasma polymerization, or the like can be selected. It is preferred that the water-repellent face be formed as a uniform film made of a water-repellent material. Further, the water repellency of the formed water-repellent face can be identified by measuring the contact angle of a water droplet on a member surface of the water-repellent face. In the case where the contact angle of water is 70° or more, it can be considered that the member surface has water repellency. It is preferred that the contact angle of water be 90° or more. Note that, the contact angle of water can be measured with a general contact angle gauge through use of pure water (ion-exchanged water). As the contact angle gauge, for example, there is mentioned an automatic contact angle meter (trade name: "CA-W", manufactured by Kyowa Interface Science Co., Ltd.).

As for the water-repellent material, for example, a fluororesin-based compound is preferably used. In particular, it is preferred that the water-repellent face be formed as a uniform resin film made of a fluororesin-based compound, and it is preferred that the resin film does not contain a metal such as nickel. Examples of the fluororesin-based compound include a polytetrafluoroethylene resin and a fluororesin having a cyclic structure. Specific examples thereof may include a trade name "POLYFLON PTFE" (manufactured by DAIKIN INDUSTRIES, LTD.), a trade name "Teflon (trademark) PTFE" (manufactured by DuPont), and a trade name "CYTOP" (manufactured by ASAHI GLASS CO., LTD.). Further, it is also possible to use, for example, any other resins containing a fluorine atom such as a fluorinated epoxy resin, a fluorinated polyimide resin, a fluorinated polyamide resin, a fluorinated acrylic resin, a fluorinated urethane resin, a fluorinated siloxane resin, and modified resins thereof. Further, as the water-repellent material, a compound containing a silicon atom or a silicone-based resin may also be used. In particular, from the viewpoint of obtaining high water repellency and durability, it is preferred to use, as the water-repellent material, a condensation product of a hydrolyzable silane compound having a fluoroalkyl group and a hydrolyzable silane compound having a cationically polymerizable group. Further, a resin obtained by curing the condensation product by irradiation with an active energy ray such as ultraviolet light may be used. The above-mentioned hydrolyzable silane compounds have a hydrolyzable group in a molecular structure thereof. As the hydrolyzable group, there may be mentioned an alkoxy group. Further, as the cationically polymerizable group, there may be mentioned a cyclic ether group, a cyclic vinyl ether group, and the like.

In the example illustrated in FIG. 5, the first electrothermal converter 421 and the ejection orifice 422 are arranged respectively in two arrays. The first electrothermal converter 421 and the ejection orifice 422 in the respective arrays are arranged so as to be shifted by the half of the arrangement pitch in an arrangement direction (sub scanning direction). Herein, 128 first electrothermal converters 421 and 128 ejection orifices 422 per array are arranged respectively at a density of 600 dpi, whereby a resolution of 1,200 dpi for each kind of ink is realized. Then, the recording element substrate configuration corresponding to the above-mentioned six kinds of inks is arranged on the first plate 430 (FIG. 4).

Control Configuration

Figure 6:
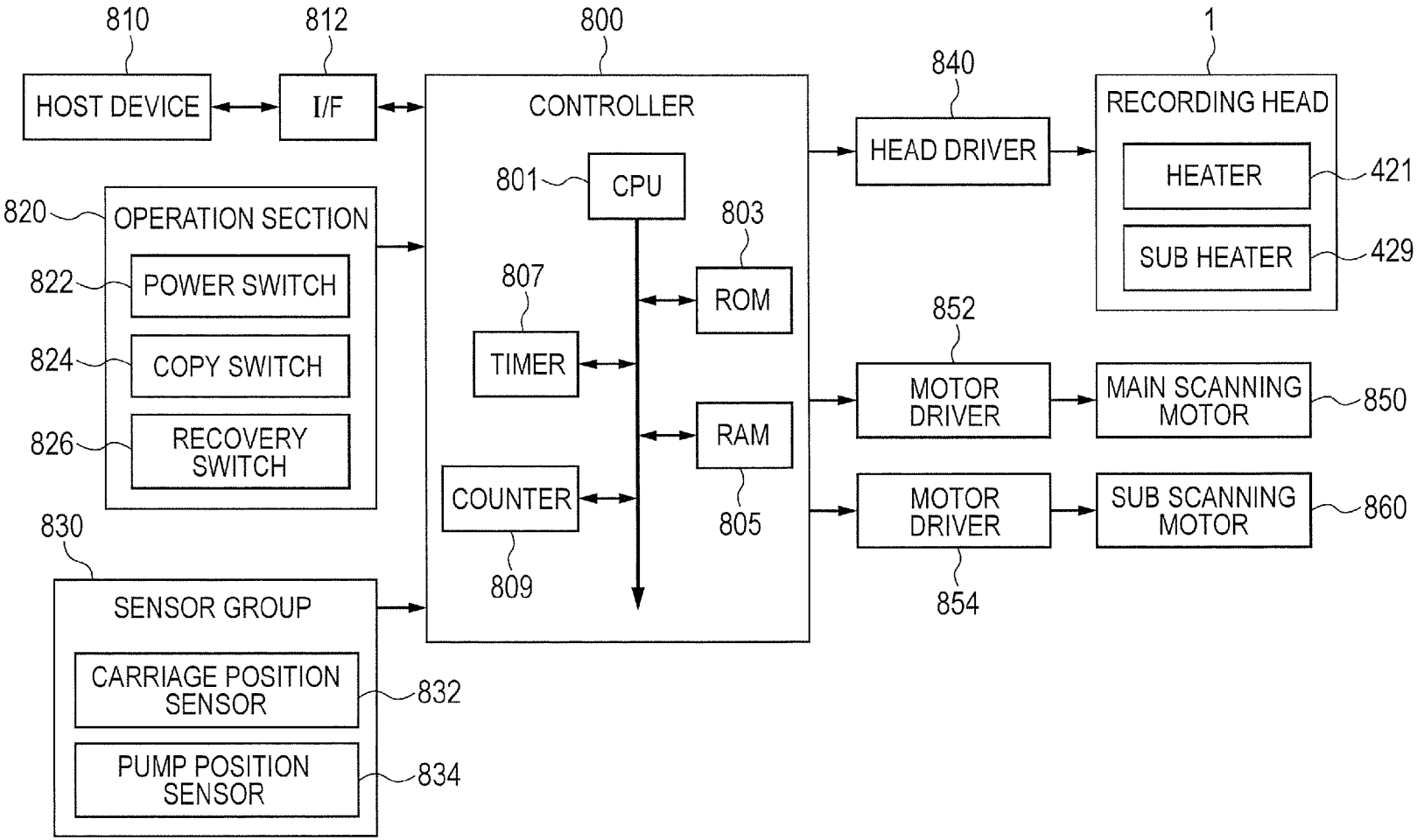
FIG. 6 is a block diagram illustrating an example of a control configuration of the ink jet recording apparatus.

FIG. 6 is a block diagram illustrating an example of a control configuration of the ink jet recording apparatus illustrated in FIG. 1. A controller 800 serves as a main control section and executes procedures illustrated in FIGS. 7 to 9. The controller 800 includes a CPU 801 in the form of, for example, a microcomputer, a ROM 803 storing a program corresponding to the procedure and other fixed data, and a RAM 805 in which a region for developing image data, a region for an operation, and the like are provided. The controller 800 further includes a timer 807 and a counter 809 to be used for performing a recovery action under predetermined conditions. A host device 810 serves as a supply source of image data and may be, for example, a computer for generating and processing image data related to recording, a reader section for reading an image, or the like. The host device 810 transmits and receives image data, other commands, status signals, and the like with respect to the controller 800 through an interface (I/F) 812.

An operation section 820 includes switches that receive an instruction input from an operator, such as a power switch 822, a copy switch 824 for giving an instruction to start recording and copying, and a recovery switch 826 for giving an instruction to start a recovery action. A sensor group 830 serves as a sensor group for detecting the state of the ink jet recording apparatus, including a carriage position sensor 832 for detecting the position of the recording head 1 such as the home position and a pump position sensor 834 for detecting the position of a suction pump. A head driver 840 drives the first electrothermal converter (heater) 421 serving as a heater for ejecting ink and the second electrothermal converter (sub heater) 429 for heating (including heat retention) the recording head 1 and ink. A main scanning motor 850 serves as a motor for moving the recording head 1 in the main scanning direction, which is driven by a motor driver 852. A sub scanning motor 860 serves as a motor for conveying the recording medium 6 in the sub scanning direction, which is driven by a motor driver 854.

Recording Method

Figure 7:
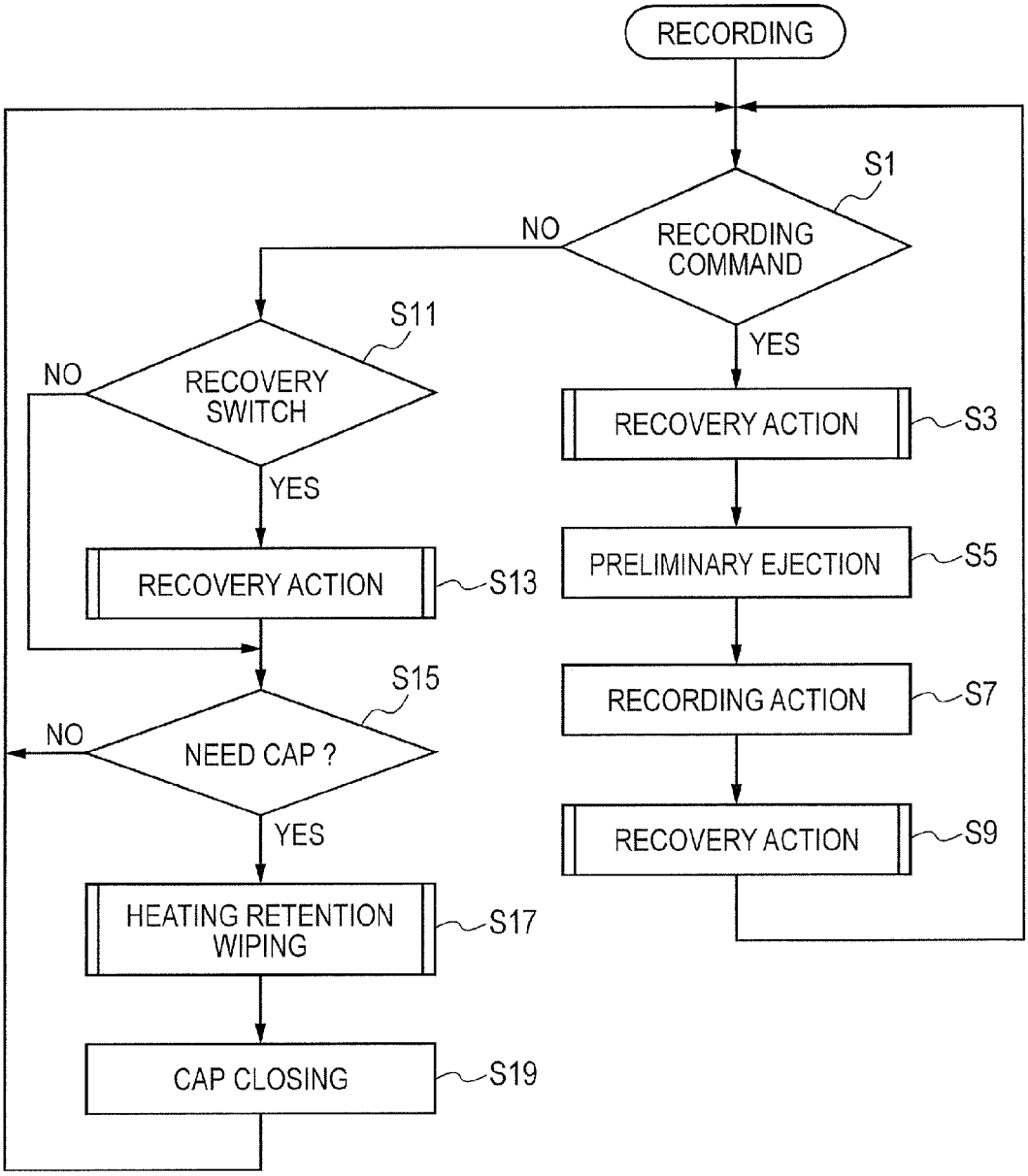
FIG. 7 is a schematic view illustrating an example of a recording procedure by an ink jet recording method of the present invention.

Next, the procedure for heating a water-repellent face is described. FIG. 7 is a schematic view illustrating an example of a recording procedure by the ink jet recording apparatus of the present invention. When a recording command (recording data) is detected in Step S1, a recovery action in Step S3 (FIG. 8) described later is performed as necessary. In the case where it is determined that the recovery action is not necessary, preliminary ejection is performed in Step S5. The preliminary ejection is performed for discharging thickened ink and foreign matters present in the vicinity of the ejection orifice and causes ink to be ejected from each ejection orifice before a recording action. The ejection of ink as preliminary ejection is not related to recording data and is performed based on preliminary ejection data. After the preliminary ejection is performed in Step S5, the recording action is started in Step S7. Even after the end of the recording action, a recovery action in Step S9 described later is performed as necessary in some cases.

Figure 8:
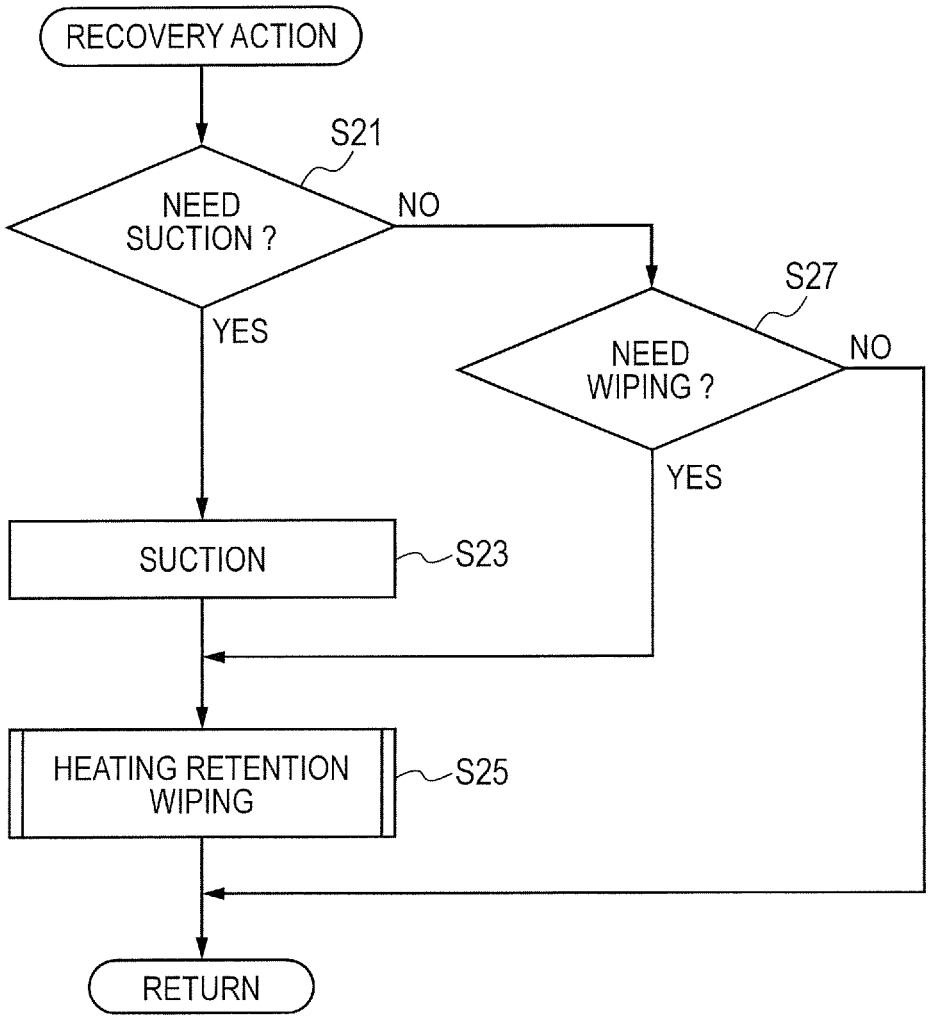
FIG. 8 is a schematic view illustrating an example of a recovery action procedure.

Next, the recovery actions in Steps S3 and S9 are described. FIG. 8 is a schematic view illustrating an example of a recovery action procedure. First, in Steps S21 and S27, it is determined whether or not suction or wiping is needed. The suction in Step S21 is performed in the following case. In the case where the state in which the suction is not performed has continued for a long period of time, ink in an ink flow path of the recording head is thickened. Further, air bubbles are generated in the ink flow path of the recording head, with the result that ink cannot be ejected normally in some cases. In order to prevent such situation, the suction is performed under predetermined conditions. In this case, the elapsed time from the final suction action is measured through use of the timer or the like provided in the ink jet recording apparatus, and the suction is controlled to be performed in the case where the elapsed time is a threshold value or more. Further, in the case where recording has been performed for a long period of time without performing the suction, air bubbles gradually adhere to the inside of the ink flow path and the vicinity of the ejection orifice of the recording head, with the result that ink cannot be ejected normally in some cases. In order to prevent such situation, the suction is performed under predetermined conditions. In this case, the accumulated number of ejection actions from the final suction action is measured through use of the counter (counter for suction) or the like provided in the ink jet recording apparatus, and the suction is controlled to be performed in the case where the accumulated number of ejection actions is a threshold value or more.

On the other hand, wiping is performed in Step S27 in the following case. In the case where recording has been performed for a long period of time without performing the wiping, a large amount of ink droplets adhere to the vicinity of the ejection orifice, with the result that ink cannot be ejected normally in some cases. In order to prevent such situation, the wiping is performed under predetermined conditions. In this case, the accumulated number of ejection actions from the final wiping action is measured through use of the counter (counter for wiping) or the like provided in the ink jet recording apparatus, and the wiping as counter wiping is controlled to be performed in the case where the accumulated number of ejection actions is a threshold value or more.

When it is determined that the suction is needed in Step S21, the process proceeds to the suction in Step S23. The suction is performed by bringing the cap unit provided in the ink jet recording apparatus and the ejection orifice face of the recording head into abutment with each other and generating a negative pressure with a pump unit joined to the cap unit. Note that, the suction pressure, the suction retention time, and the like are set to predetermined conditions optimized in accordance with the number of ejection orifices, the viscosity of ink, and the like. After the end of the suction or when it is determined that the wiping is needed in Step S27, heating retention wiping is performed in Step S25.

Figure 9:
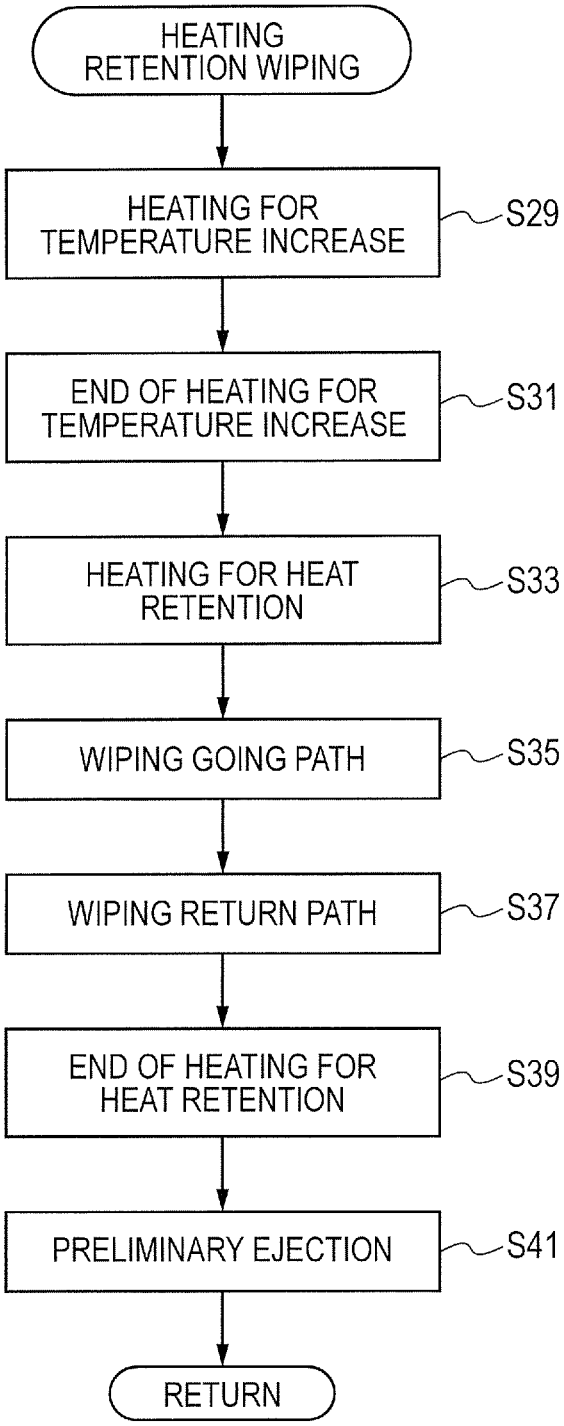
FIG. 9 is a schematic diagram illustrating an example of a heating retention wiping procedure.

FIG. 9 is a schematic view illustrating an example of a heating retention wiping procedure. First, prior to the wiping, heating for temperature increase of the water-repellent face provided with an ejection orifice is performed in Step S29. Although there is no particular limit to a heating unit, it is preferred to use the electrothermal converters such as the heater for ejecting ink and the sub heater provided separately from the heater, provided in the recording head, because the electrothermal converter can transmit heat to the water-repellent face with good efficiency. In the case of using the electrothermal converters as the heating unit, it is preferred that the electrothermal converters be driven to such an extent that ink is not caused to be ejected from the ejection orifice. The reason for this is as follows: when ink is ejected, the ink is more likely to adhere onto the water-repellent face and the removability of ink by the wiping is decreased, with the result that the enhancement of the flowability of ink on the water-repellent face is more liable to be hindered.

Even in the case where the water-repellent face is subjected to wiping while heating is continued to such a degree that the temperature increases, the effects of the present invention can be obtained sufficiently. Note that, when the temperature of the water-repellent face increases excessively, liquid components of ink are evaporated easily from the ejection orifice depending on the temperature, and ink may stick to the vicinity of the ejection orifice, with the result that the normal ejection of ink is hindered in some cases. Therefore, it is preferred that the heating for temperature increase be ended at a time when the temperature reaches an appropriate temperature in Step S31, and the heating for heat retention of keeping the water-repellent face at an appropriate temperature in Step S33 be continued. Although there is no particular limitation on the heating unit for heat retention, it is preferred to use the electrothermal converters such as the heater for ejecting ink and the sub heater provided separately from the heater, provided in the recording head, because the electrothermal converters can transmit heat to the water-repellent face with good efficiency. In the case of using the electrothermal converters as the heating unit for heat retention, it is preferred that the electrothermal converters be driven to such an extent that ink is not caused to be ejected from the ejection orifice. Although it is appropriate that the temperature for heating (including heat retention) of the water-repellent face be set to be higher than the environment temperature (25° C.), the temperature for heating is preferably 30° C. or more and 70° C. or less, more preferably 40° C. or more and 60° C. or less, particularly preferably 45° C. or more and 55° C. or less.

As described above, in the ink jet recording method of the present invention, it is required that the water-repellent face to be wiped with a wiper or the like after being heated, and the water-repellent face be heated until after the wiping. Note that, in the example illustrated in FIG. 9, the operation of heating the water-repellent face includes both the heating for temperature increase in Step S29 and the heating for heat retention in Step S33. Next, the water-repellent face is wiped with a wiper or the like while the above-mentioned heating for heat retention of the water-repellent face is continued. In the case of wiping the water-repellent face with a wiper, the movement direction of the wiper may be any one of a going direction and a return direction or may be both.

After the water-repellent face is wiped in Step S35, the wiper holder on which the wiper is set returns to a standby position in Step S37. After that, the heating for heat retention is ended in Step S39. Note that, in preparation for the case where foreign matter is generated in the vicinity of the ejection orifice, the heating retention wiping may be ended after the preliminary ejection is performed in Step S41. Even in the case where the heating for heat retention is ended in Step S39 just after the wiping of the water-repellent face in a wiping going path in Step S35, the effects of the present invention can be obtained sufficiently. Note that, when the water-repellent face is heated with the heating unit until ink is ejected, a period of time required for an ink droplet to form a stable circular liquid droplet on the water-repellent face can be shortened. Therefore, it is preferred that the heating for heat retention be ended in Step S39 before the preliminary ejection is performed in Step S41. On the other hand, in the example illustrated in FIG. 7, even in the case where an accidental situation occurs in which the ejection of the recording head is not performed normally, and consequently it is determined by the operator that the recovery switch is needed in Step S11, the above-mentioned recovery action (Step S13) is performed.

Further, in the case where the recording action or the recovery action is not performed for a long period of time, it is preferred that the ejection orifice face of the recording head be capped with a cap unit provided in the ink jet recording apparatus in Step S15. With this, the sticking of ink and the adhesion of foreign matter in the ink flow path and the vicinity of the ejection orifice can be suppressed. Note that, in the case where the ejection orifice face is capped with the cap unit, it is preferred that the heating retention wiping be performed in Step S17 prior to the cap closing in Step S19 to remove ink droplets adhering in plenty to the vicinity of the ejection orifice.

In the present invention, it is preferred that the heating retention wiping be performed at any of timing after the suction, timing before the counter wiping, and timing before the cap closing, or be performed at all those timings, because the high-level effects are obtained.

Aqueous Ink

In the ink jet recording method of the present invention, an image is recorded onto a recording medium by ejecting aqueous ink from the ejection orifice of the recording head. The aqueous ink contains a resin. An image having highlighter resistance can be recorded through use of the aqueous ink containing a resin. The resin to be contained in the aqueous ink and components to be added therein optionally are described below.

Resin

As the resin, any resins such as natural or synthetic polymers to be added generally in ink for ink jet or newly developed synthetic polymers can be used without any limitation. In particular, in order to record an image having sufficient highlighter resistance, a resin capable of remaining on a recording medium to form a film having certain strength is preferred, and in particular, a resin having an anionic group is more preferred.

The resin in the aqueous ink may be in a state of being dissolved in an aqueous medium or may be in a state of being dispersed as resin particles in the aqueous medium. It is preferred to use a water-soluble resin having an anionic group because the contact angle of ink with respect to the water-repellent face becomes high, and the reduction in ejection accuracy caused by the wetting and spreading of ink on the water-repellent face is less liable to occur. Note that, in the present invention, a resin being soluble in water is that which does not form particles capable of being measured for a particle diameter in the case where the resin is neutralized with an alkali equivalent to the acid value. In particular, it is preferred that a resin having an acid value of 40 mgKOH/g or more be used. In addition, the anionic group in the water-soluble resin may form a salt. As a cation for forming the salt, there may be mentioned, for example, a cation of an alkali metal such as lithium, sodium, or potassium; an ammonium ion ($NH_4^+$); and a cation of an organic ammonium such as dimethylamine or triethanolamine. Note that, there is no particular limitation on the upper limit of the acid value of the resin, and it is appropriate that the acid value be 300 mgKOH/g or less. In the case of using an acrylic resin, the acid value is preferably 250 mgKOH/g or less, more preferably 240 mgKOH/g or less. Further, in the case of using a urethane resin, the acid value is preferably 200 mgKOH/g or less, more preferably 160 mgKOH/g or less.

Specific examples of the resin to be used may include an acrylic resin, a polyester resin, a urethane resin, a urea resin, a polysaccharide, and a polypeptide. Of those, the acrylic resin and the urethane resin are preferred because those resins can impart ejection stability and storage stability to ink. Further, the urethane resin is particularly preferred because an image having more excellent highlighter resistance can be recorded. Note that, the term "(meth)acryl" as used herein refers to "acryl" and "methacryl".

Acrylic Resin

It is preferred to use a copolymer including a hydrophilic unit and a hydrophobic unit as the acrylic resin.

Specific examples of a monomer that becomes the hydrophilic unit through polymerization may include an acid monomer having a carboxylic acid group such as (meth) acrylic acid, crotonic acid, methacrylic acid, propylacrylic acid, isopropylacrylic acid, itaconic acid, maleic acid, or fumaric acid; an acid monomer having a sulfonic acid group such as styrenesulfonic acid, sulfonic acid-2-propylacrylamide, or butylacrylamide sulfonic acid; an acid monomer having a phosphonic acid group such as ethyl (meth)acrylic acid-2-phosphonate or ethyl acrylic acid-2-phosphonate; and anhydrides or salts of these acid monomers. Note that, as a cation for forming a salt of the acid monomer, there may be mentioned, for example, a cation of an alkali metal such as lithium, sodium, or potassium; ammonium ion ($NH_4^+$); and a cation of an organic ammonium such as dimethylamine or triethanolamine. In the present invention, it is preferred to use a water-soluble resin including a hydrophilic unit derived from (meth)acrylic acid.

In addition, specific examples of a monomer that becomes the hydrophobic unit through polymerization may include a (meth)acrylic acid ester of an aliphatic alcohol such as methyl (meth)acrylate, ethyl (meth)acrylate, butyl (meth)acrylate, hexyl(meth)acrylate, 2-ethylhexyl(meth)acrylate, nonyl (meth)acrylate, or lauryl(meth)acrylate; and a monomer having an aromatic ring such as styrene, α-methylstyrene, p-t-butylstyrene, phenyl(meth)acrylate, or benzyl (meth) acrylate. In the present invention, it is preferred to use a water-soluble resin including a hydrophobic unit derived from a (meth)acrylic acid ester of an aliphatic alcohol or a monomer having an aromatic ring.

Urethane Resin

For example, a urethane resin obtained by subjecting a polyol and a polyisocyanate to a reaction may suitably be used as the urethane resin. There may also be used a urethane resin obtained by subjecting a component serving as a chain extender or a cross-linking agent to the reaction in addition to the polyol and the polyisocyanate.

Examples of the polyol may include a short-chain polyol such as an anionic-group-containing diol; and a long-chain polyol such as polyether polyol, polyester polyol, or polycarbonate polyol. The short-chain polyol serves as a hard segment of the urethane resin, and in particular, a unit derived from an anionic-group-containing diol can be preferably used for adjusting the acid value of the urethane resin. Further, the long-chain polyol serves as a soft segment of the urethane resin, and hence can be used preferably for enhancing the flexibility of the urethane resin and enhancing the highlighter resistance of an image.

An example of the anionic-group-containing diol may be a diol containing an acid group such as a carboxylic acid group, a sulfonic acid group, or a phosphonic acid group. In particular, a diol having a carboxylic acid group such as dimethylolacetic acid, dimethylolpropionic acid, dimethylolbutanoic acid, or dimethylolbutyric acid is preferred as the anionic-group-containing diol. Dimethylolpropionic acid and dimethylolbutanoic acid are more preferred.

Examples of the long-chain polyol may include polyester polyol, polyether polyol, and polycarbonate polyol. The long-chain polyol may further have an anionic group. In the present invention, a urethane resin including a unit derived from polyether polyol is preferably used.

An example of the polyester polyol may be an acid ester. As an acid component (anionic component) for forming the acid ester, there may be mentioned, for example, an aromatic dicarboxylic acid such as phthalic acid, naphthalenedicarboxylic acid, biphenyldicarboxylic acid, or tetrahydrophthalic acid; an alicyclic dicarboxylic acid such as a hydrogenated product of the aromatic dicarboxylic acid; and an aliphatic dicarboxylic acid such as malonic acid, succinic acid, tartaric acid, oxalic acid, glutaric acid, adipic acid, pimelic acid, suberic acid, azelaic acid, sebacic acid, an alkylsuccinic acid, linolenic acid, maleic acid, fumaric acid, mesaconic acid, citraconic acid, or itaconic acid. In addition, for example, anhydrides and derivatives (alkyl ester and acid halide) of those anionic components may also be used as the anionic component.

In addition, as a component for forming the ester with the anionic component, there may be mentioned, for example, a glycol such as a (poly)alkylene glycol; and a polyhydric alcohol such as a diol or a triol. Examples of the (poly) alkylene glycol may include polyethylene glycol, polypropylene glycol, polytetramethylene glycol, poly(1,2-butylene glycol), poly(1,3-butylene glycol), and an ethylene glycol-propylene glycol copolymer. Examples of the diol may include hexamethylene glycol, tetramethylene glycol, ethylene glycol, diethylene glycol, propylene glycol, dipropylene glycol, 1,3-butanediol, 1,4-butanediol, 4,4'-dihydroxyphenylpropane, and 4,4'-dihydroxyphenylmethane. Examples of the trihydric or higher polyhydric alcohol may include glycerin, trimethylolpropane, 1,2,5-hexanetriol, 1,2,6-hexanetriol, and pentaerythritol. One kind or two or more kinds of those polyester polyols may be used as required.

Examples of the polyether polyol may include an addition polymer of an alkylene oxide and a polyhydric alcohol; and a glycol such as a (poly)alkylene glycol. Examples of the alkylene oxide may include ethylene oxide, propylene oxide, butylene oxide, and α-olefin oxide. Examples of the polyhydric alcohol or the glycol include those given as examples of the component for forming the polyester polyol. One kind or two or more kinds of those polyether polyols may be used as required.

A polycarbonate polyol produced by a known method may be used as the polycarbonate polyol. A specific example thereof is an alkanediol-based polycarbonate diol such as polyhexamethylene carbonate diol. Another example may be a polycarbonate diol obtained by subjecting a carbonate component such as an alkylene carbonate, a diaryl carbonate, or a dialkyl carbonate, phosgene, and an aliphatic diol component to a reaction. One kind or two or more kinds of those polycarbonate diols may be used as required.

In addition, examples of the polyisocyanate that forms the hard segment of the urethane resin and becomes the hydrophobic unit may include aliphatic and aromatic polyisocyanates.

Examples of the aliphatic polyisocyanate may include a polyisocyanate having a chain structure such as tetramethylene diisocyanate, hexamethylene diisocyanate, dodecamethylene diisocyanate, 2,2,4-trimethylhexamethylene diisocyanate, 2,4,4-trimethylhexamethylene diisocyanate, lysine diisocyanate, 2-methylpentane-1,5-diisocyanate, or 3-methylpentane-1,5-diisocyanate; and a polyisocyanate having a cyclic structure such as isophorone diisocyanate, hydrogenated xylylene diisocyanate, 4,4'-dicyclohexylmethane diisocyanate, 1,4-cyclohexane diisocyanate, methylcyclohexylene diisocyanate, or 1,3-bis(isocyanatomethyl)cyclohexane.

Examples of the aromatic polyisocyanate may include tolylene diisocyanate, 2,2'-diphenylmethane diisocyanate, 2,4'-diphenylmethane diisocyanate, 4,4'-diphenylmethane diisocyanate, 4,4'-dibenzyl diisocyanate, 1,5-naphthylene diisocyanate, xylylene diisocyanate, 1,3-phenylene diisocyanate, 1,4-phenylene diisocyanate, a dialkyldiphenylmethane diisocyanate, a tetraalkyldiphenylmethane diisocyanate, and α,α,α,α-tetramethylxylylene diisocyanate.

A chain extender and a cross-linking agent may be used for the urethane resin. In general, the cross-linking agent is used for synthesizing a prepolymer, and the chain extender is used for performing a chain extension reaction after the synthesis of the prepolymer. Basically, the chain extender and cross-linking agent to be used can be appropriately selected from polyisocyanates, polyols, and polyamines including the foregoing, depending on the desired applications such as the chain extension and the cross-linking. As the chain extender, those capable of cross-linking the urethane resin can also be used.

The chain extender is a compound capable of reacting with a remaining isocyanate group that has not formed a urethane bond in the polyisocyanate unit of the urethane prepolymer. As a chain extender that may suitably be used other than the above-mentioned chain extenders, there may be mentioned, for example, trimethylolmelamine and derivatives thereof, dimethylol urea and derivatives thereof, dimethylolethylamine, diethanolmethylamine, dipropanolethylamine, dibutanolmethylamine, a polyvalent amine compound such as ethylenediamine, propylenediamine, diethylenetriamine, hexylenediamine, triethylenetetramine, tetraethylenepentamine, isophoronediamine, xylylenediamine, diphenylmethanediamine, hydrogenated diphenylmethanediamine, or hydrazine, polyamide polyamine, and polyethylene polyimine. One kind or two or more kinds of those chain extenders may be used as required.

In addition, tri- or higher functional chain extenders may be used so that the urethane resin may have a cross-linked structure. As a chain extender that allows the urethane resin to have a cross-linked structure, there may be mentioned, for example, trimethylolmelamine, diethylenetriamine, triethylenetetramine, and tetraethylenepentamine in addition to the above-mentioned chain extenders. Of those chain extenders, tri- or higher functional polyamines are preferably used because of excellence in reactivity with an isocyanate group. Of those tri- or higher functional polyamines, diethylenetriamine and triethylenetetramine are particularly preferably used. The reason for this is as follows. Diethylenetriamine and triethylenetetramine respectively have three or four amino groups, and hence diethylenetriamine and triethylenetetramine react with a remaining isocyanate group efficiently to form a cross-linked structure and have an appropriately flexible molecular structure.

In the case of using the urethane resin as the resin to be contained in the aqueous ink, it is preferred that the molar ratio of a proportion (mol %) of a urethane bond in the urethane resin to a proportion (mol %) of a urea resin be 85.0/15.0 or more. The adhesiveness of the aqueous ink with respect to the water-repellent face can be further reduced by using such urethane resin. Further, it is preferred that the molar ratio of a proportion (mol %) of a urethane bond in the urethane resin to a proportion (mol %) of a urea resin be 100.0/0.0 or less.

The molar ratio of urethane bond/urea bond in the present invention is represented in the form of a fraction of the respective proportions, with the total of the proportion (mol %) of a urethane bond and the proportion (mol %) of a urea bond in the urethane resin being 100.0 mol %. That the molar ratio is 85.0/15.0 or more means that the proportion of a urethane bond is 85.0 mol % or more. Thus, the proportion of a urea bond is 15.0 mol % or less (equal to or less than a value obtained by subtracting 85.0 mol % of the urethane bond from the total of 100.0 mol %). Note that, the "molar ratio of the proportion (mol %) of a urethane bond to the molar ratio of the proportion (mol %) of a urea bond in the urethane resin"

is herein sometimes described as "molar ratio of urethane bond/urea bond" for simplicity.

Method of Verifying Resin

The acid value of the resin in the aqueous ink can be measured in accordance with the following method. First, the aqueous ink is centrifuged at 80,0000 rpm, and solid contents are removed to obtain a supernatant liquid. Hydrochloric acid (HCl) or the like is added to the obtained supernatant liquid to precipitate the resin. The obtained resin is dried to obtain a dried product of the resin. Alternatively, a resin is separated from the precipitate obtained by the above-mentioned centrifugation by solvent extraction, and the obtained resin is dried to obtain a dried product of the resin. The obtained dried product of the resin is dissolved in tetrahydrofuran, and the acid value can be measured by potentiometric titration using a potassium hydroxide methanol titrant.

Further, the molar ratio of urethane bond/urea bond in the urethane resin can be measured by the following method.

First, the aqueous ink is centrifuged at 80,000 rpm, and solid contents are removed to obtain a supernatant liquid. Hydrochloric acid (HCl) or the like is added to the obtained supernatant liquid to precipitate the resin. The obtained resin is dried to obtain a dried product of the resin. Alternatively, a resin is separated from the precipitate obtained by the above-mentioned centrifugation by solvent extraction, and the obtained resin is dried to obtain a dried product of the resin. The kinds of components (polyisocyanate, polyol, acid-group-containing diol, etc.) forming the obtained dried product of the resin are identified by pyrolysis gas chromatography. Next, a reaction product of the identified polyisocyanate and acid-group-containing diol, and a reaction product of the identified polyisocyanate and polyol are respectively prepared. The prepared reaction products are each dissolved in deuterated dimethyl sulfoxide, and the solutions are analyzed by a carbon nuclear magnetic resonance method ($^{13}$C-NMR) to confirm each chemical shift derived from a urethane bond. Further, a reaction product of the polyisocyanate and water is prepared and dried, and the obtained dried product is similarly subjected to $^{13}$C-NMR measurement to confirm a chemical shift derived from a urea bond. Further, the obtained dried product of the resin is also subjected to $^{13}$C-NMR measurement. Then, the molar ratio of urethane bond/urea bond can be determined from an integrated value of peaks derived from the urethane bond and an integrated value of peaks derived from the urea bond.

The content (mass %) of the resin in the aqueous ink is preferably 0.1 mass % or more and 10.0 mass % or less, more preferably 0.3 mass % or more and 5.0 mass % or less based on the total mass of the ink. One kind or two or more kinds of the resins may be used as required. In the case of using two or more kinds of the resins, it is preferred that at least a urethane resin and an acrylic resin be used together. In this case, the content of the urethane resin based on the total mass of the ink is preferably 0.1 times or more and 1.0 time or less, more preferably 0.3 times or more and 0.8 times or less in terms of mass ratio with respect to the content of the acrylic resin. It should be appreciated that the combination of the resins that can be used together is not limited to the foregoing. For example, a plurality of kinds of acrylic resins having different compositions may be used, and a plurality of kinds of urethane resins having different compositions may be used.

Coloring Material

The aqueous ink may be a clear ink not containing a coloring material. For example, an image having more excellent highlighter resistance can be recorded by recording an image with an aqueous ink containing a coloring material and thereafter applying an aqueous ink not containing a coloring material to a region including the recorded image. The content (mass %) of the coloring material in the aqueous ink is preferably 0.1 mass % or more and 15.0 mass % or less, more preferably 1.0 mass % or more and 10.0 mass % or less based on the total mass of the ink.

In the case where the aqueous ink contains a coloring material, a pigment or a dye can be used as the coloring material. Of those, it is preferred to use a pigment because an image having high optical density, water resistance, and weather resistance can be recorded. The dispersion system of the pigment is not particularly limited. For example, a resin-dispersed pigment dispersed with a resin dispersant, a pigment dispersed with a surfactant, and a microcapsule pigment in which at least a part of a particle surface of a pigment is covered with a resin or the like can be used. Further, a self-dispersible pigment in which a functional group containing a hydrophilic group such as an anionic group is bonded to a particle surface of a pigment, a pigment in which an organic group containing a polymer is chemically bonded to a particle surface of a pigment (resin-bonded self-dispersible pigment), and the like can also be used. It should be appreciated that pigments having different dispersion systems can also be used in combination.

Of those, it is particularly preferred to use a self-dispersible pigment in which an anionic group such as a carboxylic acid group, a sulfonic acid group, or a phosphonic acid group is bonded to a particle surface of a pigment directly or through another atomic group (—R—). The anionic group may be any of an acid-type and a salt-type. In the case where the anionic group is a salt-type, a part or a whole of the anionic group may be dissociated. As a cation serving as a counter ion in the case where the anionic group is a salt-type, there may be mentioned, for example, an alkali metal cation, ammonium, and an organic ammonium. Examples of the alkali metal cation may include lithium, sodium, and potassium. Examples of the organic ammonium may include cations of alkylamines having 1 or more and 3 or less carbon atoms; and alkanolamines having 1 or more and 4 or less carbon atoms. Further, specific examples of another atomic group (—R—) include a straight chain or branched alkylene group having 1 to 12 carbon atoms, an arylene group such as a phenylene group or a naphthylene group, an amide group, a sulfonyl group, an amino group, a carbonyl group, an ester group, and an ether group. Further, a group obtained by combining those groups may be used.

The introduced amount of the functional group of the self-dispersible pigment is preferably 0.05 mmol/g or more and 1.00 mmol/g or less, more preferably 0.05 mmol/g or more and 0.50 mmol/g or less. Note that, the unit of the introduced amount of the functional group for any functional group is the number of millimoles of the functional group for 1 g of a pigment solid content. The introduced amount of the functional group of the self-dispersible pigment can be measured as follows. First, the surface charge amount of the self-dispersible pigment is measured by colloid titration or the like.

Further, the structure of the functional group of the self-dispersible pigment is analyzed by NMR or the like, and the number n of anionic groups contained in one functional group is determined. Then, the introduced amount of the functional group is calculated from the obtained surface charge amount and the number n of the anionic groups contained in one functional group, based on the expression (surface charge amount)/n. Note that, the dissociation number of a phosphonic acid group is "1" in a pH region of the aqueous ink to be generally used.

There is no particular limitation on the kind of the pigment that can be used as the coloring material for the aqueous ink. Specific examples of the pigment include inorganic pigments such as carbon black; and organic pigments such as azo, phthalocyanine, quinacridone, isoindolinone, imidazolone, diketopyrrolopyrrole, and dioxazine. One kind or two or more kinds of those pigments may be used as required.

Further, when a dye is used as the coloring material, an image having high color developability can be recorded. There is no particular limitation on the kind of the dye that can be used as the coloring material for the aqueous ink. As the dye, it is preferred to use an anionic dye, and specific examples of a dye skeleton include azo, triphenylmethane, phthalocyanine, azaphthalocyanine, xanthene, and anthrapyridone.

Aqueous Medium

The aqueous ink can contain water or an aqueous medium that is a mixed solvent of water and a water-soluble organic solvent. It is preferred that deionized water or ion-exchanged water be used as the water. The content (mass %) of the water in the aqueous ink is preferably 50.0 mass % or more and 95.0 mass % or less based on the total mass of the ink. Further, the content (mass %) of the water-soluble organic solvent in the aqueous ink is preferably 3.0 mass % or more and 50.0 mass % or less based on the total mass of the ink. As the water-soluble organic solvent, any solvent that can be used in ink for ink jet such as alcohols, (poly)alkyleneglycols, glycol ethers, nitrogen-containing compounds, and sulfur-containing compounds can be used, and one kind or two or more kinds of the water-soluble organic solvents can be contained in the aqueous ink.

Other Components

In addition to the above-mentioned components, the aqueous ink may contain water-soluble organic compounds that are solid at room temperature, such as urea and derivatives thereof, trimethylolpropane, and trimethylolethane. The content (mass %) of the water-soluble organic compound in the aqueous ink is preferably 0.1 mass % or more and 10.0 mass % or less based on the total mass of the ink. Further, in order to obtain an aqueous ink having desired physical property values as necessary, the aqueous ink may contain various additives such as an antifoam agent, a surfactant, a pH adjuster, an antiseptic agent, a fungicide, an antioxidant, and a reduction inhibitor.

Physical Properties of Ink

The viscosity of the aqueous ink at 25° C. is preferably 2.0 mPa·s or more and 5.0 mPa·s or less, more preferably 2.0 mPa·s or more and 4.0 mPa·s or less. The pH of the aqueous ink at 25° C. is preferably 5.0 or more and 9.5 or less, more preferably 7.0 or more and 9.0 or less. The static surface tension of the aqueous ink at 25° C. is preferably 25.0 mN/m or more and 45.0 mN/m or less, more preferably 30.0 mN/m or more and 40.0 mN/m or less.

EXAMPLES

The present invention is described in more detail below by way of Examples and Comparative Examples. However, the present invention is by no means limited to Examples below and modifications may be made without departing from the gist of the invention. Note that, the terms "part(s)" and "%" regarding the amounts of components in the following description refer to "part(s) by mass" and "mass %", respectively unless otherwise stated.

Synthesis of Urethane Resin

A polyisocyanate, a polyol, and an acid-group-containing diol were supplied in usage amounts shown in Table 1-1 to a four-necked flask equipped with a thermometer, a stirrer, a nitrogen introduction pipe, and a reflux pipe. Further, 300.0 parts of methyl ethyl ketone was added to the four-necked flask, and the mixture was allowed to react at 80° C. for 6 hours in an atmosphere of nitrogen gas. After that, a chain extender of usage amounts shown in Table 1-1 was added to the resultant, and the resultant was allowed to react at 80° C. until the isocyanate group reached a desired residual ratio. Note that, the residual ratio of the isocyanate group was calculated by FT-IR analysis. After the reaction, the resultant was cooled to 40° C. and ion-exchanged water was added thereto. The resultant mixture was stirred at a high speed with a homomixer, and a potassium hydroxide aqueous solution was added to the mixture. Methyl ethyl ketone was distilled away under heating and reduced pressure to obtain a liquid (content of resin (solid content): 20.0%) containing a urethane resin (resins 1 to 21).

The acid value of the obtained urethane resin was measured by potentiometric titration using a potassium hydroxide methanol titrant. Table 1-2 shows the results. Further, an excess amount of hydrochloric acid was added to the liquid containing the urethane resin to precipitate the urethane resin, and the obtained urethane resin was dried. The dried urethane resin was dissolved in deuterated dimethyl sulfoxide, and the solution was analyzed with a nuclear magnetic resonance device (trade name: "Avance500", manufactured by BRUKER Bio Spin) by a carbon nuclear magnetic resonance method ($^{13}$C-NMR) to determine the peak integrated values of chemical shifts of a urethane bond and a urea bond. Then, "molar ratio of urethane bond/urea bond" of the obtained urethane resin was measured from the ratio of those peak integrated values. Table 1-2 shows the results.

Note that, a method of adjusting the "molar ratio of urethane bond/urea bond" in this example is described below. Isocyanate groups in the polyisocyanate gradually reduces with the progress of the reaction with hydroxy groups in the polyol and the acid-group-containing diol. The "molar ratio of urethane bond/urea bond" was adjusted by checking the residual ratio of the isocyanate group involved in the progress of the reaction as needed, adding ion-exchanged water to the solution when the residual ratio reached a given ratio, and allowing the residual isocyanate group to react with water to generate a urea group. For example, in the case of synthesizing a urethane resin having a "molar ratio of urethane bond/urea bond" of 95.0/5.0, ion-exchanged water was added to the solution at a time when the reaction rate of the isocyanate group derived from the supplied polyisocyanate reached 95.0% (residual ratio was 5.0%).

TABLE 1-1

Synthesis Conditions of Urethane Resin

| Kind of urethane resin | Polyisocyanate Kind | Polyisocyanate Usage amount (Parts) | Polyisocyanate Kind | Polyisocyanate Usage amount (Parts) | Polyol Kind | Polyol Usage amount (Parts) | Acid-containing diol Kind | Acid-containing diol Usage amount (Parts) | Chain extender Kind | Chain extender Usage amount (Parts) |
|---|---|---|---|---|---|---|---|---|---|---|
| Resin 1 | IPDI | 28 | HDI | 10.7 | PPG | 39.8 | DMPA | 21.5 | — | — |
| Resin 2 | IPDI | 41.7 | — | — | PPG | 36.8 | DMPA | 21.5 | — | — |
| Resin 3 | MDI | 46.4 | — | — | PPG | 32.1 | DMPA | 21.5 | — | — |
| Resin 4 | H12MDI | 48.4 | — | — | PPG | 30.1 | DMPA | 21.5 | — | — |
| Resin 5 | HDI | 32.4 | — | — | PPG | 46.1 | DMPA | 21.5 | — | — |
| Resin 6 | IPDI | 41.7 | — | — | PEG | 36.8 | DMPA | 21.5 | — | — |
| Resin 7 | IPDI | 41.7 | — | — | PTMG | 36.8 | DMPA | 21.5 | — | — |
| Resin 8 | IPDI | 41.7 | — | — | PES | 36.8 | DMPA | 21.5 | — | — |
| Resin 9 | IPDI | 41.7 | — | — | PC | 36.8 | DMPA | 21.5 | — | — |
| Resin 10 | IPDI | 41.5 | — | — | PPG | 34.8 | DMBA | 23.7 | — | — |
| Resin 11 | IPDI | 41.7 | — | — | PPG | 36.2 | DMPA | 21.5 | EDA | 0.6 |
| Resin 12 | IPDI | 41.7 | — | — | PPG | 36.2 | DMPA | 21.5 | DETA | 0.6 |
| Resin 13 | IPDI | 41.7 | — | — | PPG | 36.1 | DMPA | 21.5 | TETA | 0.7 |
| Resin 14 | IPDI | 44.3 | HDI | 16.9 | — | — | DMPA | 38.8 | — | — |
| Resin 15 | IPDI | 16.3 | HDI | 6.2 | PPG | 67.9 | DMPA | 9.6 | — | — |
| Resin 16 | IPDI | 16.1 | HDI | 6.1 | PPG | 68.5 | DMPA | 9.3 | — | — |
| Resin 17 | IPDI | 7.0 | HDI | 2.7 | PPG | 90.3 | — | — | — | — |
| Resin 18 | IPDI | 32.5 | HDI | 12.4 | PPG | 33.6 | DMPA | 21.5 | — | — |
| Resin 19 | IPDI | 31.2 | HDI | 11.9 | PPG | 35.4 | DMPA | 21.5 | — | — |
| Resin 20 | IPDI | 30.9 | HDI | 11.8 | PPG | 35.8 | DMPA | 21.5 | — | — |
| Resin 21 | IPDI | 26.7 | HDI | 10.2 | PPG | 41.6 | DMPA | 21.5 | — | — |

TABLE 1-2

Characteristics of Urethane Resin

| Kind of urethane resin | Acid value (mgKOH/g) | Urethane bond/urea bond (molar ratio) |
|---|---|---|
| Resin 1 | 90 | 95.0/5.0 |
| Resin 2 | 90 | 95.0/5.0 |
| Resin 3 | 90 | 95.0/5.0 |
| Resin 4 | 90 | 95.0/5.0 |
| Resin 5 | 90 | 95.0/5.0 |
| Resin 6 | 90 | 95.0/5.0 |
| Resin 7 | 90 | 95.0/5.0 |
| Resin 8 | 90 | 95.0/5.0 |
| Resin 9 | 90 | 95.0/5.0 |
| Resin 10 | 90 | 95.0/5.0 |
| Resin 11 | 90 | 95.0/5.0 |
| Resin 12 | 90 | 95.0/5.0 |
| Resin 13 | 90 | 95.0/5.0 |
| Resin 14 | 160 | 95.0/5.0 |
| Resin 15 | 40 | 95.0/5.0 |
| Resin 16 | 39 | 95.0/5.0 |
| Resin 17 | 0 | 95.0/5.0 |
| Resin 18 | 90 | 80.0/20.0 |
| Resin 19 | 90 | 84.0/16.0 |
| Resin 20 | 90 | 85.0/15.0 |
| Resin 21 | 90 | 100.0/0.0 |

Note that, the meanings of the abbreviations in Table 1-1 are described below.

IPDI: isophorone diisocyanate

HDI: hexamethylene diisocyanate

MDI: diphenylmethane diisocyanate

H12MDI: dicyclohexylmethane-4,4'-diisocyanate

PPG: polypropylene glycol (number-average molecular weight: 2,000)

PEG: polyethylene glycol (number-average molecular weight: 2,000)

PTMG: polytetramethylene glycol (number-average molecular weight: 2,000)

PES: polyester polyol (number-average molecular weight: 2,000)

PC: polycarbonate polyol (number-average molecular weight: 2,000)

DMPA: dimethylolpropionic acid

DMBA: dimethylolbutanoic acid

EDA: ethylenediamine

DETA: diethylenetriamine

TETA: triethylenetetramine

Synthesis of Acrylic Resin 200.0 parts of ethylene glycol monobutyl ether was added to a four-necked flask equipped with a stirrer, a reflux cooling device, and a nitrogen gas introduction pipe, and the temperature of the resultant was increased to 130° C. under stirring while nitrogen gas was introduced thereto. Monomers of the kinds and usage amounts shown in Table 2 and 4.0 parts of a polymerization initiator (t-butyl peroxide) were dropped onto the resultant over 3 hours. After the end of dropping, the resultant was aged for 2 hours, and ethylene glycol monobutyl ether was removed under reduced pressure to obtain a solid resin. Potassium hydroxide equivalent to the acid value of the obtained resin and ion-exchanged water were added to the obtained resin to neutralize and dissolve the resin at 80° C., with the result that a liquid (content of resin (solid content): 20.0%) containing an acrylic resin (resins A to G) was obtained. Table 2 shows the acid value of the obtained acrylic resin.

TABLE 2

Synthetic Conditions and Characteristics of Acrylic Resin

| Kind of acrylic resin | Usage amount of monomer (parts) St | α-MSt | BA | BzMA | MMA | AA | Acid value (mgKOH/g) |
|---|---|---|---|---|---|---|---|
| Resin A | 65.0 | | 20.0 | | | 15.0 | 120 |
| Resin B | 69.0 | 10.0 | | | | 21.0 | 160 |
| Resin C | | | | 79.0 | | 21.0 | 160 |
| Resin D | 60.0 | 9.0 | | | | 31.0 | 240 |

TABLE 2-continued

| Synthetic Conditions and Characteristics of Acrylic Resin | | | | | | | |
|---|---|---|---|---|---|---|---|
| Kind of acrylic resin | Usage amount of monomer (parts) St | α-MSt | BA | BzMA | MMA | AA | Acid value (mgKOH/g) |
| Resin E | 73.0 | | 20.0 | | | 7.0 | 40 |
| Resin F | 73.2 | | 20.0 | | | 6.8 | 39 |
| Resin G | | | | 25.0 | 75.0 | | 0 |

Note that, the meanings of the abbreviations in Table 2 are described below.

St: styrene

α-MSt: α-methylstyrene

BA: butyl acrylate

BzMA: benzyl methacrylate

MMA: methyl methacrylate

AA: acrylic acid

Preparation of Liquid Containing Coloring Material

Measurement of Introduced Amount of the Functional Group

The introduced amount of the functional group of a self-dispersible pigment in a pigment dispersion liquid was measured in accordance with the following procedure through use of the surface charge amount derived from an anionic group contained in a functional group. Specifically, the introduced amount of the functional group was measured by potentiometric titration using methyl glycol chitosan as a titration reagent with an automatic potentiometric titrator (trade name: "AT-510", manufactured by Kyoto Electronics Manufacturing Co., Ltd.) equipped with a streaming potential titration unit (PCD-500).

The surface charge amount derived from a phosphonic acid group was measured as follows. A pigment dispersion liquid was diluted with pure water so that the content of a pigment to be measured became about 0.03% to prepare an A-liquid. Further, a pigment dispersion liquid was ultracentrifuged under the conditions of 5° C., 80,000 rpm, and 15 hours to collect a supernatant liquid with the self-dispersible pigment removed therefrom, and the supernatant liquid was diluted with pure water by about 80 times to prepare a B-liquid. The A-liquid and the B-liquid of samples for measurement obtained as described above were quantified for phosphorus through use of an ICP emission spectroscopic device (trade name: "SPS5100", manufactured by SII Nano Technology Inc.). Then, the amount of the phosphonic acid group was determined from the difference in phosphorus amount in the obtained A-liquid and B-liquid. It was confirmed from the correspondence between the measurement result of the surface charge amount and the phosphonic acid group that the surface charge amount was "1" with respect to "1" phosphonic acid group. Thus, the surface charge amount derived from the phosphonic acid group was defined as the introduced amount of a functional group containing a phosphonic acid group (note that, the dissociation number of the phosphonic acid group in the prepared pigment dispersion liquid is "1").

Further, the surface charge amount derived from a sulfonic acid group was determined in the same way as in the case of the phosphonic acid group except for using sulfur instead of phosphorus. It was confirmed from the correspondence between the measurement result of the surface charge amount and the sulfonic acid group that the surface charge amount was "1" with respect to "1" sulfonic acid group. Thus, the surface charge amount derived from the sulfonic acid group was defined as the introduced amount of a functional group containing a sulfonic acid group.

The surface charge amount derived from a carboxylic acid group cannot be measured with the ICP emission spectroscopic device. Therefore, a value obtained by dividing the surface charge amount derived from an anionic group measured in the above by the number of carboxylic acid groups contained in one functional group was defined as the introduced amount of a functional group containing a carboxylic acid group.

Pigment Dispersion Liquid 1

20.0 g of a pigment, 5.3 mmol of a monosodium salt of ((4-aminobenzoylamino)-methane-1,1-diyl)bisphosphonic acid, 15.1 mmol of nitric acid, and 200.0 mL of pure water were mixed. As the pigment, carbon black (trade name: "Black Pearls 880", manufactured by Cabot Co.) was used. The components were mixed with a Silverson Mixer at room temperature and 6,000 rpm. Thirty minutes later, 15.1 mmol of sodium nitrite dissolved in a small amount of water was slowly added to the mixture. As a result of the addition of sodium nitrite, the temperature of the mixture reached 60° C. The mixture was allowed to react in this state for 1 hour. Then, the pH of the mixture was adjusted to 10 through use of a sodium hydroxide aqueous solution. Thirty minutes later, 20.0 mL of pure water was added to the mixture, and diafiltration was performed through use of a spectrum membrane. The content of the pigment was adjusted through use of ion-exchanged water to obtain a pigment dispersion liquid 1. The pigment dispersion liquid 1 contained a self-dispersible pigment in which a ((4-aminobenzoylamino)-methane-1,1-diyl)bisphosphonic acid group with a counter ion being sodium was bonded to a particle surface, and the content of the pigment was 10.0%. The introduced amount of the functional group was 0.34 mmol/g.

Pigment Dispersion Liquid 2

7.0 g of a pigment, 14.0 mmol of a monosodium salt of ((4-aminobenzoylamino)-methane-1,1-diyl)bisphosphonic acid, 40.0 mmol of nitric acid, and 200.0 mL of pure water were mixed. As the pigment, C.I. Pigment Blue 15:3 was used. The components were mixed with a Silverson Mixer at room temperature and 6,000 rpm. Thirty minutes later, 40.0 mmol of sodium nitrite dissolved in a small amount of water was slowly added to the mixture. As a result of the addition of sodium nitrite, the temperature of the mixture reached 60° C. The mixture was allowed to react in this state for 1 hour. Then, the pH of the mixture was adjusted to 10 through use of a sodium hydroxide aqueous solution. Thirty minutes later, 20.0 mL of pure water was added to the mixture, and diafiltration was performed through use of a spectrum membrane. The content of the pigment was adjusted through use of ion-exchanged water to obtain a pigment dispersion liquid 2. The pigment dispersion liquid 2 contained a self-dispersible pigment in which a ((4-aminobenzoylamino)-methane-1,1-diyl)bisphosphonic acid group with a counter ion being sodium was bonded to a particle surface, and the content of the pigment was 10.0%. The introduced amount of the functional group was 0.34 mmol/g.

Pigment Dispersion Liquid 3

7.0 g of a pigment, 14.0 mmol of a monosodium salt of ((4-aminobenzoylamino)-methane-1,1-diyl)bisphsphoonic acid, 40.0 mmol of nitric acid, and 200.0 mL of pure water were mixed. As the pigment, C.I. Pigment Red 122 was used. The components were mixed with a Silverson Mixer at room temperature and 6,000 rpm. Thirty minutes later, 40.0 mmol of sodium nitrite dissolved in a small amount of water was slowly added to the mixture. As a result of the addition of sodium nitrite, the temperature of the mixture reached 60° C.

The mixture was allowed to react in this state for 1 hour. Then, the pH of the mixture was adjusted to 10 through use of a sodium hydroxide aqueous solution. Thirty minutes later, 20.0 mL of pure water were added to the mixture, and diafiltration was performed through use of a spectrum membrane. The content of the pigment was adjusted through use of ion-exchanged water to obtain a pigment dispersion liquid 3. The pigment dispersion liquid 3 contained a self-dispersible pigment in which a ((4-aminobenzoylamino)-methane-1,1-diyl)bisphosphonic acid group with a counter ion being sodium was bonded to a particle surface, and the content of the pigment was 10.0%. The introduced amount of the functional group was 0.34 mmol/g.

Pigment Dispersion Liquid 4

7.0 g of a pigment, 7.0 mmol of a monosodium salt of ((4-aminobenzoylamino)-methane-1,1-diyl)bisphosphonic acid, 20.0 mmol of nitric acid, and 200.0 mL of pure water were mixed. As the pigment, C.I. Pigment Yellow 74 was used. The components were mixed with a Silverson Mixer at room temperature and 6,000 rpm. Thirty minutes later, 20.0 mmol of sodium nitrite dissolved in a small amount of water was slowly added to the mixture. As a result of the addition of sodium nitrite, the temperature of the mixture reached 60° C. The mixture was allowed to react in this state for 1 hour. Then, the pH of the mixture was adjusted to 10 through use of a sodium hydroxide aqueous solution. Thirty minutes later, 20.0 mL of pure water were added to the mixture, and diafiltration was performed through use of a spectrum membrane. The content of the pigment was adjusted through use of ion-exchanged water to obtain a pigment dispersion liquid 4. The pigment dispersion liquid contained a self-dispersible pigment in which a ((4-aminobenzoylamino)-methane-1,1-diyl)bisphosphonic acid group with a counter ion being sodium was bonded to a particle surface, and the content of the pigment was 10.0%. The introduced amount of the functional group was 0.11 mmol/g.

Pigment Dispersion Liquid 5

A solution in which 70.6 mmol of concentrated hydrochloric acid was dissolved in 5.5 g of water was cooled to a temperature of 5° C., and 9.8 mmol of 4-aminophthalic acid was added to the solution. A container containing the solution was put in an ice bath, and the solution was stirred, whereby the solution was always kept at 10° C. or less. A solution in which 24.9 mmol of sodium nitrite was dissolved in 9.0 g of water at 5° C. was added to the solution. Further, the solution was stirred for 15 minutes, and then 6.0 g of a pigment was added thereto under stirring. As the pigment, carbon black (trade name: "Black Pearls 880", manufactured by Cabot Co.) was used. Then, the solution was further stirred for 15 minutes to obtain a slurry. The obtained slurry was filtered with filter paper (trade name: "Standard Filter Paper No. 2", manufactured by Avantec Co., Ltd.). The filtered slurry was washed thoroughly with water and dried with an oven at a temperature of 110° C. to obtain a self-dispersible pigment. The content of the pigment was adjusted through use of ion-exchanged water to obtain a pigment dispersion liquid 5. The pigment dispersion liquid 5 contained a self-dispersible pigment in which a phthalic acid group with a counter ion being sodium was bonded to a particle surface, and the content of the pigment was 10.0%. The introduced amount of the functional group was 0.40 mmol/g.

Pigment Dispersion Liquid 6

25.0 g of a pigment was added under stirring to a solution in which 14.4 mmol of sulfanilic acid was dissolved in hot water, and the stirring was continued until the temperature of the liquid reached 30° C. As the pigment, carbon black (trade name: "Black Pearls 880", manufactured by Cabot Co.) was used. After that, 37.7 mmol of concentrated hydrochloric acid was added to the liquid, and further, a solution in which 14.1 mmol of sodium nitrite was dissolved in a small amount of water was added to the resultant over 1 hour. Pure water was added to the resultant after bubbles disappeared, followed by stirring, and the pH of the liquid was adjusted to 9 by adding sodium hydroxide to the liquid. Then, the liquid was filtered with a microfilter (manufactured by Fujifilm Corporation) having a pore size of 1.2 μm, and water was evaporated in an oven to adjust the content of the pigment. The resultant was further filtered with a microfilter (manufactured by Fujifilm Corporation) having a pore size of 1.2 μm to obtain a pigment dispersion liquid 6. The pigment dispersion liquid 6 contained a self-dispersible pigment in which a benzenesulfonic acid group with a counter ion being sodium was bonded to a particle surface, and the content of the pigment was 10.0%. The introduced amount of the functional group was 0.20 mmol/g.

Pigment Dispersion Liquid 7

10.0 parts of a pigment, 20.0 parts of an aqueous solution of a resin dispersant, and 70.0 parts of ion-exchanged water were mixed to obtain a mixture. As the pigment, carbon black (trade name: "Black Pearls 880", manufactured by Cabot) was used. Further, as the aqueous solution of the resin dispersant, an aqueous solution in which the content (solid content) of the acrylic resin A was 20.0% was used. The mixture was dispersed with a batch-type vertical sand mill for 3 hours, and thereafter was pressure-filtered with a microfilter (manufactured by Fujifilm Corporation) having a pore size of 1.2 μm. Then, the content of the pigment was adjusted by adding ion-exchanged water to the resultant to obtain a pigment dispersion liquid 7. The pigment dispersion liquid 7 contained a pigment dispersed with a water-soluble resin (resin dispersant), the content of the pigment was 10.0%, and the content of the water-soluble resin was 4.0%.

Pigment Dispersion Liquid 8

1.2 g of silver nitrate was added under stirring to a solution in which 7.5 mmol of 3-aminobenzylamine was dissolved in 30.0 g of water. The precipitate thus formed was removed by filtration to obtain a filtrate. The filtrate was added under stirring to a suspension in which 10.0 g of a pigment was dispersed in 70.0 g of water. As the pigment, carbon black (trade name: "Black Pearls 880", manufactured by Cabot) was used. Further, 1.6 g of concentrated hydrochloric acid were added to the resultant, and a solution in which 0.60 g of sodium nitrite was dissolved in 10.0 g of water was added. After generation of bubbles of a nitrogen gas caused by the reaction stopped, the resultant was dried in an oven at a temperature of 120° C. to obtain a pigment in which a functional group containing an amino group was bonded to a particle surface.

A dispersion liquid in which 50.0 g of the obtained pigment was dispersed in 1,450 g of ion-exchanged water was added under stirring to 1,000 g of an aqueous solution in which the content (solid content) of the acrylic resin A was 20.0% to obtain a mixture. The obtained mixture was transferred to an evaporation dish and heated at a temperature of 150° C. for 15 hours, whereby the liquid components were evaporated. Then, the resultant was cooled to room temperature to obtain an evaporation-dried product. The evaporation-dried product was added to and dispersed in distilled water having a pH adjusted to 9.0 with sodium hydroxide, and further, 1.0 mol/L of a sodium hydroxide aqueous solution was added to the resultant under stirring to adjust the pH of the liquid to 10 to 11. Thus, a part of an amino group contained in a functional group bonded to a particle surface of the pigment and a carboxyl group of the resin were subjected to dehydration condensation. Then, desalting, purification for removing impurities, and the removal of coarse particles were performed to obtain a pigment dispersion liquid 8. The pigment dispersion liquid 8 contained a pigment in which a water-soluble resin was bonded to a particle surface, the content of the pigment was 10.0%, and the content of the resin was 4.0%.

Aqueous Dye Solution 1

A commercially available aqueous dye solution (trade name: "Project Fast Black 2", manufactured by Fujifilm Corporation) containing a dye was provided, and the content of the dye was adjusted to obtain an aqueous dye solution 1. The content of the dye in the aqueous dye solution 1 was 10.0%.

Preparation of Ink

The respective components described below were mixed and thoroughly stirred. Then, the mixture was pressure-filtered with a microfilter (manufactured by Fujifilm Corporation) having a pore size of 3.0 μm to prepare each ink. Note that, "Acetylenol E100" is a nonionic surfactant (acetylene glycol ethylene oxide adduct) manufactured by Kawaken Fine Chemicals Co., Ltd. Note that, the viscosity of each prepared ink was within the range of from 2.5 Pa·s to 3.5 mPa·s.

Liquid containing coloring material (kind shown in Table 3): 30.0%

Liquid containing urethane resin (kind of urethane resin shown in Table 3): usage amount shown in Table 3 (%)

Liquid containing acrylic resin (kind of acrylic resin shown in Table 3): usage amount shown in Table 3 (%)

Glycerin: 9.0%

Diethylene glycol: 5.0%

Triethylene glycol: 5.0%

Acetylenol E100: 0.2%

Ion-exchanged water: balance with which total becomes 100.0%

Evaluation

In the present invention, based on the following evaluation criteria, "AAA", "AA", "A", and "B" were defined as an acceptable level, and "C" was defined as an unacceptable level. Table 3 shows the evaluation results.

Ejection Accuracy

Each prepared ink was filled into the ink cartridge illustrated in FIG. 2, and the ink cartridge was mounted on the ink jet recording apparatus illustrated in FIG. 1. In this example, the recording duty of a solid image recorded under the condition of applying two ink droplets having a mass of 12 ng±10% per droplet to a unit region of 1/600 inch×1/600 inch was defined as 100%. A solid image having a recording duty of 50% was recorded in a size of 19 cm×26 cm onto 10 A4-size PPC paper sheets (trade name: "GF-500", manufactured by Canon Inc.), and a nozzle check pattern was recorded onto one sheet. Then, the solid image was recorded onto 10,000 sheets under the same condition as above, and a nozzle check pattern was recorded again onto one sheet. The nozzle check pattern after the solid image was recorded onto 10 sheets was compared to the nozzle check pattern after the solid image was recorded onto 10,000 sheets, and the ejection accuracy was evaluated in accordance with the evaluation criteria described below. Various conditions for the evaluation are listed below.

Evaluation Criteria of Ejection Accuracy

AAA: The nozzle check pattern was recorded normally in both the case after the solid image was recorded onto 10 sheets and the case after the solid image was recorded onto 10,000 sheets.

AA: The nozzle check pattern was recorded normally after the solid image was recorded onto 10 sheets. The nozzle check pattern after the solid image was recorded onto 10,000 sheets contained slight irregularities.

A: The nozzle check pattern contained slight irregularities in both the case after the solid image was recorded onto 10 sheets and the case after the solid image was recorded onto 10,000 sheets.

B: The nozzle check pattern after the solid image was recorded onto 10 sheets contained slight irregularities. The nozzle check pattern after the solid image was recorded onto 10,000 sheets contained more irregularities.

C: The nozzle check pattern contained significant irregularities in both the case after the solid image was recorded onto 10 sheets and the case after the solid image was recorded onto 10,000 sheets.

Terms and Conditions

Wiper penetration amount*: 1.1±0.5 mm (*: Height from the position of an ejection orifice face to a wiper tip end)

Wiping speed: 80 mm/sec

Recording head: 1,200 dpi, 1,024 nozzles

Wiping with an accumulated ejection number counter: every time of recording of one A4-size sheet Suction with an accumulated ejection number counter: every time of recording of 10 A4-size sheets Heating temperature for increasing the temperature of a water-repellent face: 50° C. or more in terms of the detection temperature measured with a temperature sensor provided in a recording head Heating temperature for heat retention of a water-repellent face: 50° C. or more in terms of the detection temperature measured with a temperature sensor provided in a recording head Test environment: temperature of 15° C., relative humidity of 10%

Wiping of an ejection orifice face with a wiper: In the procedure illustrated in FIG. 9, the ink jet recording apparatus was adjusted so that the ejection orifice face of the recording head was wiped with a wiper during the "wiping going path" in Step S35.

Water-repellent Face

The water-repellent face was obtained by subjecting an ejection orifice face to water-repellent treatment through use of a water-repellent material of the following (1) or (2).

Water-repellent face (1): a resin obtained by curing a condensation product of a hydrolyzable silane compound having a fluoroalkyl group (compound having a fluoromethyl group and a methoxy group) and a hydrolyzable silane compound having a cationically polymerizable group (compound having an epoxy group and an ethoxy group)

Water-repellent face (2): a hydrolyzable compound having a fluoroalkyl group (compound having a fluoromethyl group and a methoxy group)

Heating Method

Method (1): Both the heater for ink ejection and the sub heater provided in the recording head were used.

Method (2): Only the heater for ink ejection provided in the recording head was used.

Method (3): Only the sub heater provided in the recording head was used.

Heating Retention Wiping Procedure

Procedure (1): performed in accordance with the procedure illustrated in FIG. 9.

Procedure (2): performed in accordance with the procedure illustrated in FIG. 9 except that "end of heating for heat retention" in Step S39 was shifted to just after "wiping going path" in Step S35 in the procedure illustrated in FIG. 9.

Procedure (3): performed in accordance with the procedure illustrated in FIG. 9 except that "heating for temperature increase" in Step S29, "end of heating for temperature increase" in Step S31, "heating for heat retention" in Step S33, and "end of heating for heat retention" in Step S39 were not performed in the procedure illustrated in FIG. 9.

Procedure (4): performed in accordance with the procedure illustrated in FIG. 9 except that "heating for heat retention" in Step S33 and "end of heating for heat retention" in Step S39 were not performed in the procedure illustrated in FIG. 9.

Procedure (5): performed in accordance with the procedure illustrated in FIG. 9 except that, in the procedure illustrated in FIG. 9, "heating for heat retention" in Step S33 and "end of heating for heat retention" in Step S39 were not performed, and the "heating for temperature increase" in Step S29 and "end of heating for temperature increase" in Step S31 was shifted to just after "wiping return path" in Step S37.

Recording Timing

Timing (1): performed in accordance with the procedure of Steps S1, S3, S21, S23, S25, S5, and S7 in the procedure illustrated in FIGS. 7 and 8. This procedure involves performing heating retention wiping after suction and then performing a recording action.

Timing (2): performed in accordance with the procedure of Steps S1, S11, S15, S17, S19, S1, S3, S21, S27, and S7 in the procedure illustrated in FIGS. 7 and 8. This procedure involves performing heating retention wiping after suction and performing recording after further performing cap closing.

Highlighter Resistance

Each prepared ink was filled into the ink cartridge illustrated in FIG. 2, and the ink cartridge 410 was mounted on the ink jet recording apparatus illustrated in FIG. 1. In this example, the recording duty of a solid image recorded under the condition of applying two ink droplets having a mass of 12 ng±10% per droplet to a unit region of 1/600 inch×1/600 inch was defined as 100%. A solid image having a recording duty of 50% was recorded with a size of 1 inch×1 inch onto a PPC paper sheet (trade name: "GF-500", manufactured by Canon Inc.). Five minutes after the recording, the solid image on the obtained recorded product was marked with a yellow line marker (trade name: "OPTEX2", manufactured by Zebra Co., Ltd). Stains on the marked portion were checked, and the highlighter resistance was evaluated in accordance with the following evaluation criteria.

Evaluation Criteria of Highlighter Resistance

A: No stain was found even after marking.

B: Stains were hardly found even after marking.

C: Stains were found after marking.

TABLE 3

Evaluation Conditions and Evaluation Results

| | | Recording apparatus | | | | Ink | | | | | | Evaluation result | |
|---|---|---|---|---|---|---|---|---|---|---|---|---|---|
| | | | | | | | | Liquid containing resin | | | | | |
| | | Water-repellent face | Temp. adjusting method | Heating retention wiping procedure | Record. timing | Ink No. | Liquid containing coloring material | Kind of urethane resin | Usage amount (%) | Kind of acrylic resin | Usage amount (%) | Ejection accuracy | Highlighter resistance |
| Example | 1 | (1) | (1) | (1) | (1) | 1 | Pigment dispersion liquid 1 | 1 | 5.0 | — | — | AAA | A |
| | 2 | (1) | (1) | (1) | (1) | 2 | Pigment dispersion liquid 2 | 1 | 5.0 | — | — | AAA | A |
| | 3 | (1) | (1) | (1) | (1) | 3 | Pigment dispersion liquid 3 | 1 | 5.0 | — | — | AAA | A |
| | 4 | (1) | (1) | (1) | (1) | 4 | Pigment dispersion liquid 4 | 1 | 5.0 | — | — | AAA | A |
| | 5 | (1) | (1) | (1) | (1) | 5 | Pigment dispersion liquid 5 | 1 | 5.0 | — | — | AAA | A |
| | 6 | (1) | (1) | (1) | (1) | 6 | Pigment dispersion liquid 6 | 1 | 5.0 | — | — | AAA | A |
| | 7 | (1) | (1) | (1) | (1) | 7 | Pigment dispersion liquid 1 | 2 | 5.0 | — | — | AAA | A |
| | 8 | (1) | (1) | (1) | (1) | 8 | Pigment dispersion liquid 1 | 3 | 5.0 | — | — | AAA | A |
| | 9 | (1) | (1) | (1) | (1) | 9 | Pigment dispersion liquid 1 | 4 | 5.0 | — | — | AAA | A |
| | 10 | (1) | (1) | (1) | (1) | 10 | Pigment dispersion liquid 1 | 5 | 5.0 | — | — | AAA | A |
| | 11 | (1) | (1) | (1) | (1) | 11 | Pigment dispersion liquid 1 | 6 | 5.0 | — | — | AAA | A |
| | 12 | (1) | (1) | (1) | (1) | 12 | Pigment dispersion liquid 1 | 7 | 5.0 | — | — | AAA | A |
| | 13 | (1) | (1) | (1) | (1) | 13 | Pigment dispersion liquid 1 | 8 | 5.0 | — | — | AAA | A |
| | 14 | (1) | (1) | (1) | (1) | 14 | Pigment dispersion liquid 1 | 9 | 5.0 | — | — | AAA | A |
| | 15 | (1) | (1) | (1) | (1) | 15 | Pigment dispersion liquid 1 | 10 | 5.0 | — | — | AAA | A |
| | 16 | (1) | (1) | (1) | (1) | 16 | Pigment dispersion liquid 1 | 11 | 5.0 | — | — | AAA | A |
| | 17 | (1) | (1) | (1) | (1) | 17 | Pigment dispersion liquid 1 | 12 | 5.0 | — | — | AAA | A |
| | 18 | (1) | (1) | (1) | (1) | 18 | Pigment dispersion liquid 1 | 13 | 5.0 | — | — | AAA | A |

TABLE 3-continued

| Evaluation Conditions and Evaluation Results | | | | | | | | | | | | | |
|---|---|---|---|---|---|---|---|---|---|---|---|---|---|
| | | Recording apparatus | | | | Ink | | | | | | Evaluation result | |
| | | | | | | | | Liquid containing resin | | | | | |
| | | Water-repellent face | Temp. adjusting method | Heating retention wiping procedure | Record. timing | Ink No. | Liquid containing coloring material | Kind of urethane resin | Usage amount (%) | Kind of acrylic resin | Usage amount (%) | Ejection accuracy | High-lighter resistance |
| | 19 | (1) | (1) | (1) | (1) | 19 | Pigment dispersion liquid 1 | 1 | 2.5 | A | 2.5 | AAA | A |
| | 20 | (1) | (1) | (1) | (1) | 20 | Pigment dispersion liquid 1 | 1 | 2.5 | B | 2.5 | AAA | A |
| | 21 | (1) | (1) | (1) | (1) | 21 | Pigment dispersion liquid 7 | 1 | 5.0 | — | — | AAA | A |
| | 22 | (1) | (1) | (1) | (1) | 22 | Pigment dispersion liquid 8 | 1 | 5.0 | — | — | AAA | A |
| | 23 | (1) | (1) | (1) | (1) | 23 | Aqueous dye solution 1 | 1 | 5.0 | — | — | AAA | A |
| | 24 | (1) | (1) | (1) | (1) | 24 | — | 1 | 5.0 | — | — | AAA | A |
| | 25 | (1) | (2) | (1) | (1) | 1 | Pigment dispersion liquid 1 | 1 | 5.0 | — | — | AAA | A |
| | 26 | (1) | (3) | (1) | (1) | 1 | Pigment dispersion liquid 1 | 1 | 5.0 | — | — | AAA | A |
| | 27 | (1) | (1) | (2) | (1) | 1 | Pigment dispersion liquid 1 | 1 | 5.0 | — | — | A | A |
| | 28 | (1) | (2) | (1) | (2) | 1 | Pigment dispersion liquid 1 | 1 | 5.0 | — | — | AAA | A |
| | 29 | (1) | (1) | (1) | (1) | 25 | Pigment dispersion liquid 1 | 14 | 5.0 | — | — | AAA | A |
| | 30 | (1) | (1) | (1) | (1) | 26 | Pigment dispersion liquid 1 | 15 | 5.0 | — | — | AAA | A |
| | 31 | (1) | (1) | (1) | (1) | 27 | Pigment dispersion liquid 1 | 16 | 5.0 | — | — | AA | A |
| | 32 | (1) | (1) | (1) | (1) | 28 | Pigment dispersion liquid 1 | 17 | 5.0 | — | — | AA | A |
| | 33 | (1) | (1) | (1) | (1) | 29 | Pigment dispersion liquid 1 | — | — | A | 5.0 | AA | B |
| | 34 | (1) | (1) | (1) | (1) | 30 | Pigment dispersion liquid 1 | — | — | B | 5.0 | AA | B |
| | 35 | (1) | (1) | (1) | (1) | 31 | Pigment dispersion liquid 1 | — | — | C | 5.0 | AA | B |
| | 36 | (1) | (1) | (1) | (1) | 32 | Pigment dispersion liquid 1 | — | — | D | 5.0 | AA | B |
| | 37 | (1) | (1) | (1) | (1) | 33 | Pigment dispersion liquid 1 | — | — | E | 5.0 | AA | B |
| | 38 | (1) | (1) | (1) | (1) | 34 | Pigment dispersion liquid 1 | — | — | F | 5.0 | AA | B |
| | 39 | (1) | (1) | (1) | (1) | 35 | Pigment dispersion liquid 1 | — | — | G | 5.0 | AA | B |
| | 40 | (1) | (1) | (1) | (1) | 36 | Pigment dispersion liquid 1 | 18 | 5.0 | — | — | AA | A |
| | 41 | (1) | (1) | (1) | (1) | 37 | Pigment dispersion liquid 1 | 19 | 5.0 | — | — | AA | A |
| | 42 | (1) | (1) | (1) | (1) | 38 | Pigment dispersion liquid 1 | 20 | 5.0 | — | — | AAA | A |
| | 43 | (1) | (1) | (1) | (1) | 39 | Pigment dispersion liquid 1 | 21 | 5.0 | — | — | AAA | A |
| | 44 | (2) | (1) | (1) | (1) | 1 | Pigment dispersion liquid 1 | 1 | 5.0 | — | — | B | A |
| Comp. Example | 1 | (1) | — | (3) | (1) | 1 | Pigment dispersion liquid 1 | 1 | 5.0 | — | — | C | A |
| | 2 | (1) | (1) | (4) | (1) | 1 | Pigment dispersion liquid 1 | 1 | 5.0 | — | — | C | A |
| | 3 | (1) | (1) | (5) | (1) | 1 | Pigment dispersion liquid 1 | 1 | 5.0 | — | — | C | A |
| | 4 | — | (1) | (1) | (1) | 1 | Pigment dispersion liquid 1 | 1 | 5.0 | — | — | C | A |
| | 5 | (1) | (1) | (1) | (1) | 40 | Pigment dispersion liquid 1 | — | — | — | — | AAA | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-272238, filed Dec. 27, 2013, Japanese Patent Application No. 2014-123260, filed Jun. 16, 2014, and Japanese Patent Application No. 2014-237799, filed Nov. 25, 2014, which are hereby incorporated by reference herein in their entirety.

What is claimed is:

1. An ink jet recording method for recording an image onto a recording medium by ejecting an aqueous ink containing a resin from an ejection orifice through use of an ink jet recording apparatus, the ink jet apparatus including a recording head having a water-repellent face subjected to water-repellent treatment as an ejection orifice face provided with an ejection orifice; a wiping unit configured to wipe the water-repellent face; and a heating unit configured to heat the water-repellent face, the ink jet recording method comprising:

a heating step of heating the water-repellent face with the heating unit; and a wiping step of wiping the water-repellent face with the wiping unit, wherein the water-repellent face is continuously heated until after the wiping of the water-repellent face, wherein the water-repellent face is formed of a condensation product of a hydrolyzable silane compound having a fluoroalkyl group and a hydrolyzable silane compound having a cationically polymerizable group.

2. An ink jet recording method according to claim 1, wherein the heating step is performed through use of an electrothermal converter to be used as the heating unit, the electrothermal converter being capable of being driven to such an extent that the aqueous ink is not caused to be ejected.

3. An ink jet recording method according to claim 1, wherein the water-repellent face is continuously heated with the heating unit until the aqueous ink is ejected as a preliminary ejection.

4. An ink jet recording method according to claim 1, wherein the resin has an acid value of 40 mgKOH/g or more.

5. An ink jet recording method according to claim 1, wherein the resin comprises a urethane resin.

6. An ink jet recording method according to claim 5, wherein a molar ratio of a proportion (mol %) of a urethane bond in the urethane resin to a proportion (mol %) of a urea bond is 85.0/15.0 or more.

7. An ink jet recording apparatus for use in the ink jet recording method according to claim 1, comprising:

the recording head having the water-repellent face subjected to water-repellent treatment as the ejection orifice face provided with the ejection orifice;

the wiping unit configured to wipe the water-repellent face; and the heating unit configured to heat the water-repellent face.

8. A method of cleaning a recording head comprising:

a wiping step of wiping a water-repellent face of a recording head having the water-repellent face subjected to water-repellent treatment as an ejection orifice face provided with an ejection orifice to remove an aqueous ink containing a resin and adhering to the water-repellent face; and a heating step of heating the water-repellent face, wherein the wiping step is performed after starting the heating step, and the heating step is continued after ending the wiping step, wherein the water-repellent face is formed of a condensation product of a hydrolyzable silane compound having a fluoroalkyl group and a hydrolyzable silane compound having a cationically polymerizable group.

9. An ink jet recording method according to claim 4, wherein the resin has an acid value of 300 mgKOH/g or less.

10. An ink jet recording method according to claim 5, wherein the urethane resin has an acid value of 40 mbKOH/g or more and 200 mgKOH/g or less.

11. An ink jet recording method according to claim 5, wherein the urethane resin has an acid value of 40 mgKOH/g or more and 160 mgKOH/g or less.

12. An ink jet recording method according to claim 1, wherein the resin comprises an acrylic resin.

13. An ink jet recording method according to claim 12, wherein the acrylic resin has an acid value of 40 mgKOH/g or more and 250 mgKOH/g or less.

14. An ink jet recording method according to claim 12, wherein the acrylic resin has an acid value of 40 mgKOH/g or more and 240 mgKOH/g or less.

15. An ink jet recording method according to claim 1, wherein a content (mass %) of the resin in the aqueous ink is 0.1 mass % or more and 10.0 mass % or less.

16. An ink jet recording method according to claim 1, wherein the resin comprises both a urethane resin and an acrylic resin.

17. An ink jet recording method according to claim 1, wherein the aqueous ink comprises at least one of a pigment and a dye as a coloring material.

18. An ink jet recording method according to claim 1, wherein the aqueous ink comprises a pigment as a coloring material.

19. An ink jet recording method according to claim 18, wherein the pigment is at least one of the group consisting of a resin-dispersed pigment, a surfactant-dispersed pigment, a microcapsule pigment, and a self-dispersible pigment.

20. An ink jet recording method according to claim 18, wherein the pigment is a self-dispersible pigment.

21. An ink jet recording method according to claim 18, wherein the pigment is a self-dispersible pigment in which an anionic group selected from the group consisting of a carboxylic acid group, a sulfonic acid group and a phosphonic acid group is bonded to a particle surface of the pigment directly or through another atomic group.

* * * * *